US007299003B2

(12) United States Patent
Kurotaka et al.

(10) Patent No.: US 7,299,003 B2
(45) Date of Patent: Nov. 20, 2007

(54) FIXING UNIT AND IMAGE FORMING APPARATUS PROVIDING A QUICK START-UP AND REDUCTION IN ENERGY CONSUMPTION

(75) Inventors: Shigeo Kurotaka, Kanagawa (JP); Masami Tomita, Shizuoka (JP); Katsuhiro Echigo, Saitama (JP); Takashi Fujita, Kanagawa (JP); Toshihiko Baba, Tokyo (JP); Hisashi Kikuchi, Kanagawa (JP); Hiroyuki Kunii, Kanagawa (JP); Atsushi Nakafuji, Tokyo (JP); Yukimichi Someya, Saitama (JP); Kohji Ue, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 151 days.

(21) Appl. No.: 11/044,013

(22) Filed: Jan. 28, 2005

(65) Prior Publication Data

US 2005/0201783 A1 Sep. 15, 2005

(30) Foreign Application Priority Data

Jan. 29, 2004 (JP) ..... 2004-020658
Feb. 26, 2004 (JP) ..... 2004-051437

(51) Int. Cl.
*G03G 15/20* (2006.01)

(52) U.S. Cl. ..... 399/329

(58) Field of Classification Search ..... 399/329; 219/216

See application file for complete search history.

(56) References Cited

U.S. PATENT DOCUMENTS 6,055,390 A 4/2000 Kurotaka et al.
6,198,888 B1 3/2001 Kurotaka et al.
6,243,559 B1 6/2001 Kurotaka et al.
6,501,935 B2 12/2002 Hirai et al.
6,795,676 B2 9/2004 Kikuchi et al.
6,795,678 B2 9/2004 Yura et al.
6,985,690 B2 * 1/2006 Odell et al. ..... 399/333
7,054,573 B2 * 5/2006 Hirai et al. ..... 399/70
2002/0086229 A1 * 7/2002 Yuasa et al. ..... 430/108.4
2003/0152857 A1 * 8/2003 Sugiura et al. ..... 430/109.2
2004/0009020 A1 * 1/2004 Shimizu et al. ..... 399/328
2005/0201783 A1 9/2005 Kurotaka et al.

FOREIGN PATENT DOCUMENTS

JP 63-313182 12/1988

(Continued)

OTHER PUBLICATIONS

U.S. Appl. No. 11/512,385, filed Aug. 30, 2006, Tomita.

(Continued)

*Primary Examiner*—Quana Grainger
(74) *Attorney, Agent, or Firm*—Oblon, Spivak, McClelland, Maier & Neustadt, P.C.

(57) ABSTRACT

A fixing belt is heated by electromagnetic induction. The fixing belt has a heat generating layer that has a thickness not greater than 40 μm and a releasing layer that has a thickness not less than 10 μm. A toner that includes at least a binder resin, a colorant, and a mold releasing agent, and has a glass transition temperature in a range of 35° C. to 50° C. and an outflow-start temperature in a range of 80° C. to 110° C., is used.

19 Claims, 9 Drawing Sheets

FOREIGN PATENT DOCUMENTS

| | | |
|---|---|---|
| JP | 1-263679 | 10/1989 |
| JP | 8-22206 | 1/1996 |
| JP | 2516886 | 4/1996 |
| JP | 2673959 | 7/1997 |
| JP | 2813297 | 8/1998 |
| JP | 11-344830 | 12/1999 |
| JP | 2001-235893 | 8/2001 |
| JP | 2001-272812 | 10/2001 |
| JP | 2001-272818 | 10/2001 |
| JP | 2002-82550 | 3/2002 |
| JP | 2002-91075 | 3/2002 |
| JP | 2002-91076 | 3/2002 |
| JP | 2002-148844 | 5/2002 |
| JP | 3347310 | 9/2002 |
| JP | 2003-50477 | 2/2003 |
| JP | 3423616 | 4/2003 |
| JP | 2004226572 A * | 8/2004 |

OTHER PUBLICATIONS

U.S. Appl. No. 11/511,380, filed Aug. 29, 2006, Suzuki et al.
U.S. Appl. No. 11/521,494, filed Sep. 15, 2006, Takagaki et al.
U.S. Appl. No. 11/681,739, filed Mar. 2, 2007, Seto et al.
U.S. Appl. No. 11/683,086, filed Mar. 7, 2007, Takemoto et al.
U.S. Appl. No. 11/669,817, filed Jan. 31, 2007, Suzuki et al.

* cited by examiner

FIXING UNIT AND IMAGE FORMING APPARATUS PROVIDING A QUICK START-UP AND REDUCTION IN ENERGY CONSUMPTION

CROSS-REFERENCE TO RELATED APPLICATIONS

The present document incorporates by reference the entire contents of Japanese priority documents, 2004-020658 filed in Japan on Jan. 29, 2004, and 2004-051437 filed in Japan on Feb. 26, 2004.

BACKGROUND OF THE INVENTION

1) Field of the Invention

The present invention relates to a thermal fixing unit in an image forming apparatus such as a copying machine, a printer, and a facsimile, and particularly to a fixing unit in the form of a belt.

2) Description of the Related Art

There is a strong demand that the image forming apparatuses operate at high-speed and also consume less energy. One approach to achieve this is to improve the thermal efficiency of the fixing unit of the image forming apparatuses. The examples of the image forming apparatus are copying machines, printers, facsimile machines, and multi-function peripherals.

In the image forming apparatuses, a toner image is formed on a recording medium generally by two methods: an image transfer method and a direct transfer method. The examples of the recording medium are an ordinary paper, a photosensitive paper, an electrostatic recording paper, and an OHP (overhead projector) sheet. The toner image is then fixed to the recording medium by a fixing unit. The fixing units mainly employ two methods to fix the toner image: a contact heating process and an electromagnetic induction heating process. The examples of the contact heating process are a heat roller process and a film heating process.

The fixing unit that uses the heat roller process, basically includes a pair of rotating rollers: a fixing roller and a pressurizing roller. The fixing roller is heated by a heat source such as a halogen lamp. The pressurizing roller is in contact with the fixing roller and also applies pressure to the fixing roller. A paper with the toner image is introduced between the so called fixing nip, which is a contact portion of the pair of the rotating rollers, and then carried forward. The toner image is fused or fixed to the paper due to heat and pressure while the paper passes between the fixing roller and the pressurizing roller.

A conventional fixing unit that uses the film heating process has been proposed in Japanese Patent Application Laid-open Publication Nos. S63-313182 and H1-263679. The fixing unit that uses the film heating process includes bringing the paper near a heating member while there is a heat-resistant, thin, fixing film between them, and allowing the paper to slide over the fixing film. The heating member can be a ceramic heater that includes a resistive layer on a ceramic substrate such as alumina and aluminum nitride that has properties such as high heat resistivity, insulation, and good thermal conductivity. Because the fixing film is thin and has a low thermal capacity, an efficiency of heat transfer is higher than that of the fixing unit that uses the heat roller process. Therefore, the warm-up time of the fixing unit that uses the film heating process is shorter. This allows a quicker start-up and energy conservation.

Japanese Patent Application Laid-open Publication No. H8-22206 discloses a conventional fixing machine that uses the electromagnetic induction heating process. This fixing machine includes a magnetic metal member and a heating member. An alternating magnetic field is applied to the magnetic metal member. As a result, eddy currents are generated in the magnetic metal member and Joule's heat is produced in the magnetic metal member. The metal member is heated by the Joule's heat.

Various toners are used in the fixing unit that uses the electromagnetic induction heating process. For example, Japanese Patent Application Laid-open Publication No. H11-344830 proposes a toner that includes a strong magnetic material and a resin that has a glass transition point in a range of 45° C. to 65° C. and a softening point in a range of 80° C. to 140° C.

Moreover, Japanese Patent Application Laid-open Publication No. 2001-235893 proposes a toner that includes a styrene-acrylic resin in which the glass transition point and an MI value are regulated, and a fixed polyolefin wax are used.

Furthermore, Japanese Patent Application Laid-open Publication No.2001-272812 proposes a toner that includes a polyester resin that has a regulated endothermic peak of wax and a regulated dynamic viscoelasticity is used.

Moreover, Japanese Patent Application Laid-open Publication No. 2001-272818 proposes a toner of which a molecular weight distribution and an endothermic peak temperature are regulated.

Furthermore, Japanese Patent Application Laid-open Publication No. 2002-91075 proposes a toner that includes a resin in which a composition of both acid and alcohol are regulated.

Moreover, Japanese Patent Application Laid-open Publication No. 2002-91076 discloses a toner of which the melt viscosity is regulated and includes a polyester resin in which an insoluble content of THF (tetrahydrofuran) and an acid value are regulated.

Moreover, a technology in which a low temperature offset and a high temperature offset are prevented by regulating a heat capacity of a belt, has been disclosed in Japanese Patent No. 2813297.

Furthermore, a technology in which a separation is improved by improving a permeating property of a mold releasing agent by using a spherical shaped toner that contains a mold releasing agent that has a low melting point, in a heating passage before the nip of the belt fixing unit, has been disclosed in Japanese Patent No. 3423616.

SUMMARY OF THE INVENTION

It is an object of the present invention to propose a fixing unit that enables speedy start-up and energy conservation.

A fixing unit according to an aspect of the present invention includes an endless fixing belt having a heat generating layer of a thickness not more than 40 μm and a releasing layer of a thickness not less than 10 μm; a heating unit that heats the fixing belt with electromagnetic induction; a fixing member and a pressurizing member that are in a pressed contact, wherein the fixing belt passes through a nip between the fixing member and the pressurizing member, and a recording material that holds an unfixed toner image is passed through the nip to fix the toner image. A toner to form the toner image includes at least a binder resin, a colorant, and a mold releasing agent, and has a glass transition temperature in a range of 35° C. to 50° C. and an outflow-start temperature in a range of 80° C. to 110° C.

A fixing unit according to another aspect of the present invention includes a transferring and fixing member that includes a rotating body in a form of a roller or a belt on which a toner image is transferred; a heating unit that heats a toner on the transferring and fixing member; and a pressurizing roller that forms a nip with the transferring and fixing member. A toner image is fixed on a paper that passes through the nip formed between the transferring and fixing member and the pressurizing roller, and a toner that forms the toner image includes at least a binder resin, a colorant, and a mold releasing agent, and has a glass transition temperature in a range of 35° C. to 50° C. and an outflow-start temperature in a range of 80° C. to 110° C.

Image forming apparatuses according to still other aspects of the present invention include the above fixing units according to the present invention.

The other objects, features, and advantages of the present invention are specifically set forth in or will become apparent from the following detailed description of the invention when read in conjunction with the accompanying drawings.

DETAILED DESCRIPTION

Figure 1:
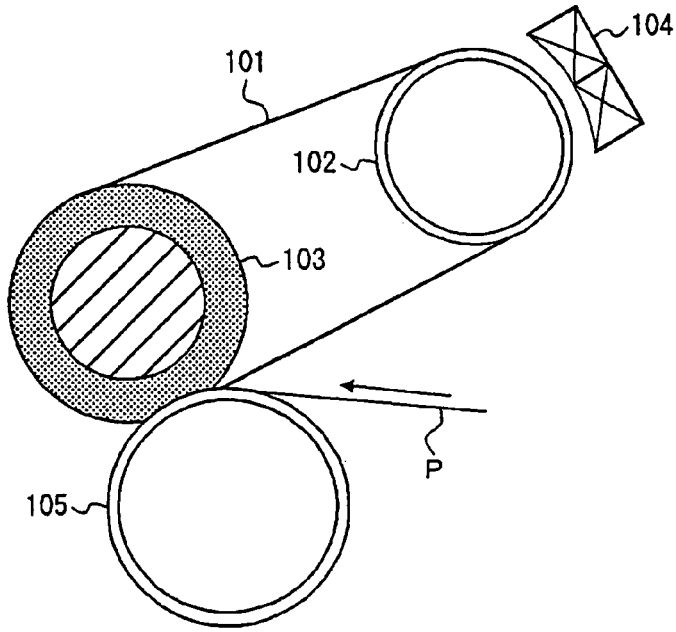
FIG. 1 is a cross-sectional view of a fixing experiment equipment for evaluating a fixing belt.

Exemplary embodiments of the present invention are described with reference to the accompanying diagrams.

A fixing unit according to the present invention has a sufficiently wide fixing nip, which enables a fixing at low temperature. Moreover, a fixing belt that has a low heat capacity is used and one or both of the fixing belt and the fixing nip that is formed by a fixing member (fixing roller, fixed fixing member) and a pressurizing member (pressurizing roller, fixed pressurizing member) are let to be thermal insulated. With such a structure, by using an appropriate combination with a toner, the fixing unit realizes high speed start-up and energy conservation. Moreover, an excellent fixity and prevention of offset is achieved.

In particular, a thermal insulating roller (in this case, defined as a roller that has an Asker hardness not less than 80 degrees) that has stiffness is used as a pressurizing member. A pressurizing roller that has hardness greater than the hardness of the fixing member is used. By doing so, a transporting by the fixing belt becomes stable and since the fixing nip is formed in a direction such that a paper is not rolled around the belt, there is an improvement in a separation of paper.

As a thermal insulating structure for the fixing member or the pressurizing member, a foamed silicone rubber or a silicone layer filled with a hollow thread and hollow particles is used. Such a thermal insulating structure improves a rate of air content, thereby enabling to improve an air thermal-insulating effect.

Moreover, the structure of the silicone layer filled with the hollow thread and the hollow particles has a greater surface hardness of the roller, and smaller compression permanent set, and can be used as a roller to drive the fixing belt.

The fixing belt used in the fixing unit according to the present invention is a low heat capacity belt that has a heat generating layer of a thickness not greater than 40 micrometer (μm) and a releasing layer of thickness not less than 10 μm. If the thickness of the heat generating layer (a conductive material of a metal such as nickel and stainless steel) is greater than 40 μm, there is an increase in the stiffness of the belt and a flexibility that is a peculiarity of the belt is lost, thereby affecting the winding around the fixing member and the formation of the nip. As a result, the separation and fixity are declined. Therefore, according to the present invention, the thickness of the heat generating layer is not let to be greater than 40 μm. Moreover, to ensure an abrasion resistance with the lapse of time of a surface releasing layer of the fixing belt, the surface releasing layer has to be at least 10-μm thick.

Because the fixing belt that has low heat capacity and a toner that includes at least a binder resin, a colorant, and a mold releasing agent, with a glass transition temperature in a range of 35 degree centigrade (° C.) to 50° C. and an outflow-start temperature in a range of 80° C. to 110° C. are used, a high speed start-up and the energy conservation as well as excellent fixity and prevention of offset are achieved.

Incidentally, a problem peculiar to the fixing belt that is heated by an induction heating process is that, as compared to a conventional belt for a radiant heat source (halogen lamp), the stiffness of the belt is more due to the heat generating layer. (metallic conductive material). For this reason, a width of the nip becomes small and a quality of fixing (fixity, gloss, and high image quality) is deteriorated. Moreover, if a bearing in the nip is low, there is a tendency of deterioration of the quality of fixing.

Therefore, to ensure a predetermined nip width in a belt fixing by the induction heating process, in a case of a belt that has high stiffness and high surface hardness, even higher fixing pressure (bearing) is required to be exerted.

However, on the other hand, increasing the bearing leads to an improvement in the quality of fixing (fixity, gloss, and high image quality) and a fixing temperature can also be lowered, which is another advantage. In other words, it was revealed that it is effective for energy conservation and high speed start-up.

Inventors of the present invention, carried out experiments by using nine types of fixing belts shown in table 1 below, with a structure that has layers such as the heat generating layer (with Ni (nickel), Ag (silver), and stainless steel as a conductive material), an intermediate layer (an elastic layer for uniform fixing), and an outer layer (a fluorine-contained resin used for a release effect and an oil less) superimposed on a base substrate of Ni or PI (polyimide). When the base substrate is Ni, a separate heat generating layer need not be provided (belt nos. 2 to 4). In a belt No. 3, the intermediate layer of silicone rubber serves as the outer layer (releasing) layer.

TABLE 1

| Type of belt | Substrate (thickness in μm) | Heat generating layer (thickness in μm) | Intermediate layer (thickness in μm) | Outer layer (thickness in μm) | Heat capacity (J/K · cm$^2$) |
|---|---|---|---|---|---|
| No. 1 | Pl (25) | Ni (10) | — | Fluorine contained resin (10) | 0.01 |
| No.2 | Ni (40) | — | | Fluorine contained resin (10) | 0.017 |
| No. 3 | Ni (40) | — | Silicone rubber (150) | — | 0.038 |
| No. 4 | Ni (40) | — | Silicone rubber (150) | Fluorine contained resin (30) | 0.045 |
| No. 5 | Pl (50) | Ni (40) | Silicone rubber (150) | Fluorine contained resin (20) | 0.052 |
| No. 6 | Pl (50) | Ni (40) | Silicone rubber (200) | Fluorine contained resin (20) | 0.068 |
| No. 7 | Pl (75) | Ni (40 μm) | Silicone rubber (200) | Fluorine contained resin (20) | 0.072 |
| No. 8 | Pl (100) | Ni (40 μm) | Silicone rubber (200) | Fluorine contained resin (20) | 0.077 |
| No. 9 | Pl (100) | Ni (40 μm) | Silicone rubber (300) | Fluorine contained resin (30) | 0.087 |

A fixing unit shown in FIG. 1 was used as an experiment equipment. This fixing unit includes a fixing belt 101, a heating roller 102, a fixing roller 103, an induction-heating unit 104, and a pressurizing roller 105. The fixing belt 101 is stretched over the heating roller 102 and the fixing roller 103, and is heated by the induction-heating unit 104. The pressurizing roller 105 makes a pressed contact with the fixing roller 103 with the fixing belt 101 sandwiched between the two. A paper P passes through a fixing nip that is formed by the pressurized contact between the fixing roller 103 and the pressurizing roller 105 with the fixing belt 101 sandwiched between the two, and an unfixed image on the paper is fixed.

Nine types of belts mentioned in Table 1 were used as the fixing belt 101. The heating roller 102 is a 0.8-millimeter (mm) thick, hollow-insude, aluminum roller and has a diameter of 30 mm. The fixing roller 103 has a 5-mm thick elastic layer (foamed silicone) of its surface and has a diameter of 38 mm. The pressurizing roller 105 has a 0.5-mm thick silicone rubber and 30-micrometer (μm) thick PFA on a 1.0-mm thick iron core, and has a diameter of 40 mm. A transit time of the paper through the nip is 100 ms. Toners from toner No. 1 to toner No. 3 described later were used. An evaluation of the start-up time, fixity, and offset measured for nine types of belts is shown in table 2 below.

TABLE 2

| Type of belt | Heat capacity (J/K · cm$^2$) | Start-up time | Fixity, offset |
|---|---|---|---|
| No. 1 | 0.01 | Appropriate | Not appropriate |
| No. 2 | 0.017 | Appropriate | Ok |
| No. 3 | 0.038 | Appropriate | Appropriate |
| No. 4 | 0.045 | Appropriate | Appropriate |
| No. 5 | 0.052 | Appropriate | Appropriate |
| No. 6 | 0.068 | Appropriate | Appropriate |
| No. 7 | 0.072 | Appropriate | Appropriate |
| No. 8 | 0.077 | Ok | Appropriate |
| No. 9 | 0.087 | Not appropriate | Appropriate |

As a result of the experiments, it was revealed that if the heat capacity of the fixing belt 101 is not greater than 0.017 J/K·cm$^2$, a decrease in temperature in the nip is greater and the fixity deteriorates. This can be prevented by increasing the fixing temperature. However, by doing so, the fixing temperature becomes high, the start-up time becomes long, and the energy conservation cannot be achieved. It was also revealed that if the heat capacity of the fixing belt is not less than 0.077 J/K·cm$^2$, similarly the start-up time becomes long and the energy conservation cannot be achieved. Nowadays, the start-up time not longer than 30 seconds, and desirably not longer than 10 seconds, has been sought after.

The fixing roller, which is a fixing member that forms the nip, may be elastic foam body (such as silicone rubber). Moreover, it is desirable that the pressurizing roller is a thin roller (thickness of core not greater than 1 mm) with low heat capacity or a roller that has a thermal insulating structure. A heat loss can be reduced by decreasing heat conductivity from the heating belt to the pressurizing roller, and a heating efficiency of the belt can be improved.

An evaluation experiment was carried out for comparison by using a fixing unit that has a conventional structure.

The fixing unit with the conventional structure uses the so called heat roller process in which a fixing roller (heat roller) and a pressurizing roller are allowed to make a pressed contact. The fixing roller is a hollow core with silicone rubber and fluorine contained resin coated on it as the elastic layer and the releasing layer respectively, which is used normally as a heat roller for color fixing. The roller has a built-in halogen lamp as a source of heat that supplies heat from the inside of the roller to a surface of the roller. Concretely, the base substrate of the fixing roller is made of 2-mm thick iron or stainless steel on which 2-mm thick layer of silicone rubber and 20-μm thick layer of fluorine-contained resin are coated. The heat capacity of this fixing roller is 1.04 J/K·cm$^2$.

In this evaluation experiment, the start-up time was in a range of 5 minutes to 10 minutes (when the roller diameter is let to be in a range of 40 mm to 60 mm) which was much slower than the start-up time in the induction heating process.

Apart from this, the induction heating process normally has the following characteristics as compared to a radiant heating process (by using the source of light such as halogen lamp).

(1) The induction heating process has high energy conversion efficiency. It is possible to have 85% energy conversion efficiency in the induction heating, which is approximately 10% by using the halogen lamp. Therefore, as a matter of course, the start-up in the induction heating process is quick.

(2) In the induction heating process, variable output is possible by a variable control of frequency of electric power that is supplied to a heating coil, which is difficult with the halogen lamp.

(3) In the induction heating process, it is possible to perform a self temperature control in which magnetic properties (Curie point) of a heated product are used and it is advantageous from a point of view of a safety of burning and ignition.

(4) In the induction heating process, a temperature ripple is less (as an object to be heated is heated directly, there are advantages such as a small time lag for temperature control).

(5) The induction heating process is less risky as far as safety point is considered (however there is a possibility of ignition due to wrapping of the paper due to an external local heating process), whereas the radiant heat source causes many problems.

The following is a description of a toner that is used in the fixing unit according to the present invention.

Many characteristics of toner related to the fixity of toner are known. Among these characteristics, a ½ outflow temperature (softening point) is known to be related to the fixity. However, according to the present invention, no relevance has been seen between the ½ outflow temperature (softening point) and the fixity, and it was revealed that a good fixity can be achieved by using a toner that satisfies both of the characteristics viz. the glass transition temperature in a range of 35° C. to 50° C. and the outflow-start temperature in a range of 80° C. to 110° C.

If the glass transition temperature is lower than 35° C., sometimes there is an occurrence of offset during fixing. On the other hand, if the glass transition temperature is higher than 50° C., no sufficient fixity can be achieved and an image tends to come off easily from a transfer paper. Moreover, if the outflow-start temperature is lower than 80° C., sometimes there is an occurrence of offset during fixing. On the other hand, if the outflow-start temperature is higher than 110° C., no sufficient fixity can be achieved and the image tends to come off easily from the transfer paper.

An object of the present invention can be achieved assuredly by maintaining a peak molecular weight of the toner in a range of 3000 to 8000. In other words, if the peak molecular weight is less than 3000, sometimes there is an occurrence of offset while fixing. On the other hand, if the peak molecular weight is greater than 8000, no sufficient fixity can be achieved and the image tends to come off easily from the transfer paper.

The following is a general description of a method for measurement of the glass transition point Tg.

TG-DSC system TAS-100 manufactured by RIGAKU CORPORATION was used as an apparatus to measure the glass transition point Tg.

To start with, about 10 mg of a sample is put in a sample container made of aluminum and the sample container is mounted on a holder unit. The holder unit is set in an electric furnace. The sample is heated by raising a temperature from a room temperature to 150° C. at a programming rate of 10° C./min and left to be at 150° C. for 10 minutes. Then the sample is cooled down to the room temperature and left to be at the room temperature for 10 minutes. The sample is heated again in a nitrogen atmosphere up to 150° C. at the programming rate of 10° C./min and a DSC measurement was carried out. The glass transition point Tg was calculated from a point of contact of a tangent of an endothermic curve near the glass transition point Tg and a base line, by using an analysis system in TAS-100 system.

The following is a description of the outflow-start temperature.

The outflow-start temperature of toner can be measured by using a flow tester. An elevated flow tester CFT500D manufactured by SHIMADZU SEISAKUSHO can be used. Each temperature can be read from a flow curve of this flow tester. Conditions for measurement were let to be, load: 5 kg/cm$^2$, programming rate: 3.0° C./min, bore diameter of die: 1.00 mm, and length of die: 10.0 mm.

The peak molecular weight of a toner component is measured by the following method.

About 1 gram (g) of a toner is weighed precisely in an Erlenmeyer flask and 10 g to 20 g of THF (tetrahydrofuran) is added to it to make a THF solution with 5% to 10% binder concentration. A column is allowed to be stabilized in a heat chamber at 40° C. THF is poured as a solvent at a rate of flow 1 ml/min to the column at 40° C. and 20 μl of the THF sample solution is poured. The molecular weight of the sample is calculated from a relationship between a retention time and a logarithmic value of a calibration curve that is prepared by a monodispersed polystyrene standard sample.

The calibration curve is prepared by using a polystyrene standard sample. A monodispersed polystyrene standard sample with the molecular weight in a range of $2.7\times10^2$ to $6.2\times10^2$ manufactured by TOSOH CORPORATION is to be used.

A refractive index (RI) detector is used as a detector. A combination of TSK gel, G1000H, G2000H, G2500H, G3000H, G4000H, G5000H, G6000H, G7000H, and GMH manufactured by TOSOH CORPORATION is used as a column From among resins that satisfy required toner characteristics, resins that have following composition can be used as a binder resin in the toner.

The examples of the binder resin are monopolymers of styrenes such as polyester, polystyrene, poly p-chlorostyrene, polyvinyl toluene and their substitutes, and copolymers of styrene such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinylmethyl ether copolymers, styrene-vinylethyl ether copolymers, styrene-vinylmethyl ketone copolymers, styrene-butadiene copolymers, styrene-isoprene copolymers, styrene-acrylonitrile indene copolymers, styrene-maleic acid copolymers, and styrene-maleate copolymers.

Moreover, the following resins upon mixing can be used as a binder resin.

The examples are polymethyl methacrylate, polybutyl methacrylate, polyvinyl chloride, polyvinyl acetate, polyethylene, polypropylene, polyurethane, polyamides, epoxy resins, polyvinyl butyral, polyacrylic acid resins, rosin, modified rosin, turpentine resins, phenol resins, aliphatic hydrocarbon resins or alicyclic hydrocarbon resins, aromatic petroleum resins, chlorinated paraffin, and paraffin wax.

Among these resins, polyester resins are desirable as sufficient fixity can be achieved. The polyester resins are obtained by a condensation polymerization of an alcohol and a carboxylic acid. Examples of alcohols that can be used are diols such as polyethylene glycol, diethylene glycol, triethylene glycol, 1,2-propylene glycol, 1,3-propylene glycol, 1,4-butandiol, neopentyl glycol, and 1,4-butanediol, ethered bisphenols such as 1,4-bis(hydroxymethyl)cyclohexane, bisphenol A, hydrogen additive bisphenol A, polyoxyethylened bisphenol A, and polyoxypropylened bisphenol A, dihydric alcohol monomers in which the abovementioned resins are replaced by a saturated or an unsaturated hydrocarbon group having a carbon number from 3 to 22, and other dihydric alcohol monomers.

Examples of carboxylic acids that can be used to obtain the polyester resin are maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, a dihydric organic acid monomer in which the abovementioned acids are replaced by a saturated or an unsaturated hydrocarbon group having carbon number from 3 to 22, acid anhydrides of these acids, dimers of lower alkyl esters and linoleic acid, and other dihydric organic acid monomers.

For obtaining the polyester resin that is to be used as the binder resin, it is appropriate to use not only a polymer of a bifunctional monomer mentioned above but also a polymer that contains a component formed by a polyfunctional monomer not less than a trifunctional monomer. Examples of a polyhydric alcohol monomer not below the trihydric alcohol monomers that are polyfunctional monomers are, sorbitol, 1,2,3,6-hexanetetrol, 1,4-sorbitan, pentaerythritol, dipentaerythritol, tripentaerythritol, cane sugar, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of polyhydric carboxylic acid monomers not below the trihydric carboxylic acid monomers are 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3,-dicarboxyl-2-methyl-2-methylenecarboxypropane, tetra(methylenecarboxyl)methane, 1,2,7,8-octanetetracarboxylic acid, enboltrimeric acid, and acid anhydrides of these compounds.

A mold releasing agent can be included in the toner according to the present invention to improve toner release ability on a surface of the fixing belt while fixing. Any known mold releasing agent can be used, and particularly, free fatty acid-free carnauba wax, montan wax, oxidized rice wax, and ester wax can be used independently or in combination.

A carnauba wax that has micro crystals, acid number not greater than 5, and a particle size not bigger than 1 μm when dispersed in a toner binder, is desirable. Regarding the montan wax, a refined montan wax rather than a normal mineral wax and similar to the carnauba wax, having micro crystals and acid value from 5 to 14, is desirable. The oxidized rice wax is an air oxidized rice bran wax and it is desirable that it has an acid value in a range of 10 to 30. If the acid value of each wax is below this range, a low temperature fixing temperature rises and the fixing at a low temperature becomes insufficient. Whereas, if the acid value is above the range, a cold offset temperature rises and the fixing at a low temperature becomes insufficient. An amount of the wax to be added is from 1 part by weight to 15 parts by weight for 100 parts by weight of the binder resin and the desirable amount is in a range of 3 parts by weight to 10 parts by weight. If the amount is less than 1 part by weight, the toner release effect is poor and the desired effect cannot be achieved. If the amount is more than 15 parts by weight, a spent to a carrier is remarkable.

A charge controlling agent can be included in a toner to impart a charge to the toner. All known conventional charge controlling agents can be used. Examples of a positive charge controlling agent are nigrosin, basic dyes, lake pigments of the basic dyes, and quaternary ammonium salt compounds, and examples of a negative charge controlling agent are metal salts of monoazo pigments, metal complexes of dicarboxylic acid, naphthoic acid, and salicylic acid. An amount to be used of this polarity controlling agent is determined by a type of the binder resin, presence of absence of an additive that is used according to the requirement, and a method of toner manufacturing including a dispersion method, and is not restricted to any particular amount. The amount in a range of 0.01 parts by weight to 8 parts by weight of the polarity controlling agent for 100 parts by weight of the binder resin is used and the desirable amount is in a range of 0.1 parts by weight to 2 parts by weight. If the amount is less than 0.01 parts by weight, an effect with respect to a change in an amount of charging Q/M during a change in an environment, is small and if the amount is more than 8 parts by weight, the low temperature fixity is deteriorated.

Chromium contained monoazo pigments, cobalt contained monoazo pigments, and iron contained monoazo pigments can be used independently or in combination as the metal contained monoazo pigments. By adding these monoazo pigments, a rise (time until saturation) of an amount of charge Q/M in a developer is even superior. The amount of the metal contained monoazo pigment to be used is determined similarly as the amount of the polarity controlling agent, by the type of the binder resin, the presence or absence of the additive that is used according to the requirement, and the method of toner manufacturing including the dispersion method, and is not restricted to any particular amount. The amount in a range of 0.1 parts by weight to 10 parts by weight of the monoazo pigments for 100 parts by weight of the binder resin used, and the desirable amount is in a range of 1 part by weight to 7 parts by weight. If the amount is less than 0.1 parts by weight, the effect is not much and if the amount is more than 10 parts by weight, defects such as a decline in a saturation level of the charging amount occur.

It is particularly desirable to use a metal salt of a derivative of salicylic acid in a color toner. However, charging of the toner can be stabilized by adding a transparent or a white color substance according to the requirement that does not cause a color tone of the color toner to be lost. Concretely, organic boron salts, fluorine contained quaternary ammonium salts, and calyx allene compounds are used. However, it is not restricted to these compounds.

Moreover, a magnetic material can be included in the toner and the toner can be used as a magnetic toner. Iron oxides such as magnetite, hematite, and ferrite, metals such as iron, cobalt, and nickel or alloy of these metals with metals such as aluminum, cobalt, copper, lead, magnesium, tin, zinc, antimony, beryllium, bismuth, cadmium, calcium, manganese, selenium, titanium, tungsten, and vanadium and their mixtures are examples of the magnetic material that are to be included in the magnetic toner.

It is desirable to use these ferromagnetic materials having an average particle size in a range of 0.1 μm to 2 μm and an amount to be included in the toner is approximately in a range of 20 parts by weight to 200 parts by weight for 100 parts by weight of the resin component. The desirable amount is 40 parts by weight to 150 parts by weight for 100 parts by weight of the resin component.

All known colorants for toner can be used.

As a colorant for black color, colorants such as carbon black, aniline black, furnace black, and lamp black can be used. As a colorant of cyan, colorants such as phthalocyanine blue, methylene blue, victoria blue, methyl violet, aniline blue, and ultra marine blue can be used. As a colorant for magenta, colorants such as rhodamine 6G lake, dimethyl quinacridone, watching red, rose red iron oxide, rhodamine B, and alizarin lake can be used. As a colorant for yellow, colorants such as chrome yellow, benzidine yellow, hanza yellow, naphthol yellow, molybdenum orange, quinoline yellow, and tartrazine can be used.

Apart from these colorants, dyes and pigments that enable to obtain toners of yellow, magenta, cyan, and black colors can be used. All known conventional dyes and pigments such as carbon black, lamp black, ultramarine blue, aniline blue, phthalocyanine blue, phthalocyanine green, hanza yellow, rhodamine 6G lake, chalco oil blue, chrome yellow, quinacridone, benzidine yellow, rose red iron oxide, triaryl methane can be used independently or upon mixing.

To improve fluidity, hydrophobic silica, titanium oxide, alumina may be used as an external additive. Metal salts of fatty acids and polyvinylidene fluoride may also be used as an external additive according to the requirement.

All known carriers can be used as a carrier for letting the toner to be a two-component developer. Examples of carrier are magnetic powders such as iron powder, ferrite powder, and nickel powder, and materials such as glass bids, a surface of which is treated by resin.

Resin powders such as styrene-acrylic copolymers, silicone resins, maleic acid resins, fluorine contained resins, polyester resins, and epoxy resins can be used for coating the carrier. In a case of the styrene-acrylic resins, it is desirable to use a copolymer resin that has styrene content in a range of 30 percent by weight to 90 percent by weight. In this case, if the styrene content is less than 30 percent by weight, developing characteristics are poor and if the styrene content is more than 90 percent by weight, a coating film becomes hard and tends to come off easily, thereby shortening a life of the carrier. Moreover, apart from the resins mentioned above, an adhesive agent, a hardening agent, a lubricant, a conductive agent, and a charge controlling agent may be included in a resin coating of the carrier.

As a carrier nucleon that are coated by the silicone resin, ferromagnetic metals such as iron, cobalt, and nickel, alloys and compounds such as magnetite, hematite, and ferrite, and glass beads that have been known so far may be used. Normally, an average particle size of these nucleons is in a range of 10 μm to 1000 μm, and the desirable particle size is in a range of 30 μm to 500 μm. An amount of the silicone resin to be used is normally from 1 percent by weight to 10 percent by weight with respect to the amount of the carrier nucleon.

Any silicone resin that has been known so far may be used. Silicone resins available in a market such as KR261, KR271, KR272, KR275, KR280, KR282, KR285, KR251, KR155, KR220, KR201, KR204, KR205, KR206, SA-4, ES1001, ES1001N, ES1002T, and KR3093 manufactured by SHIN-ETSU SILICONES, and SR2100, SR2101, SR2107, SR2110, SR2108, SR2109, SR2115, SR2400, SR2410, SR2411, SH805, SH806A, and SH840 manufactured by TORAY SILICONE CO., LTD., can be used. As a method of forming a silicone resin layer, the silicone resin may be applied on a surface of the carrier nucleon by a method such as spraying and soaking.

Next, a concrete structure of the fixing unit is described with reference to the following embodiment.

Figure 2:
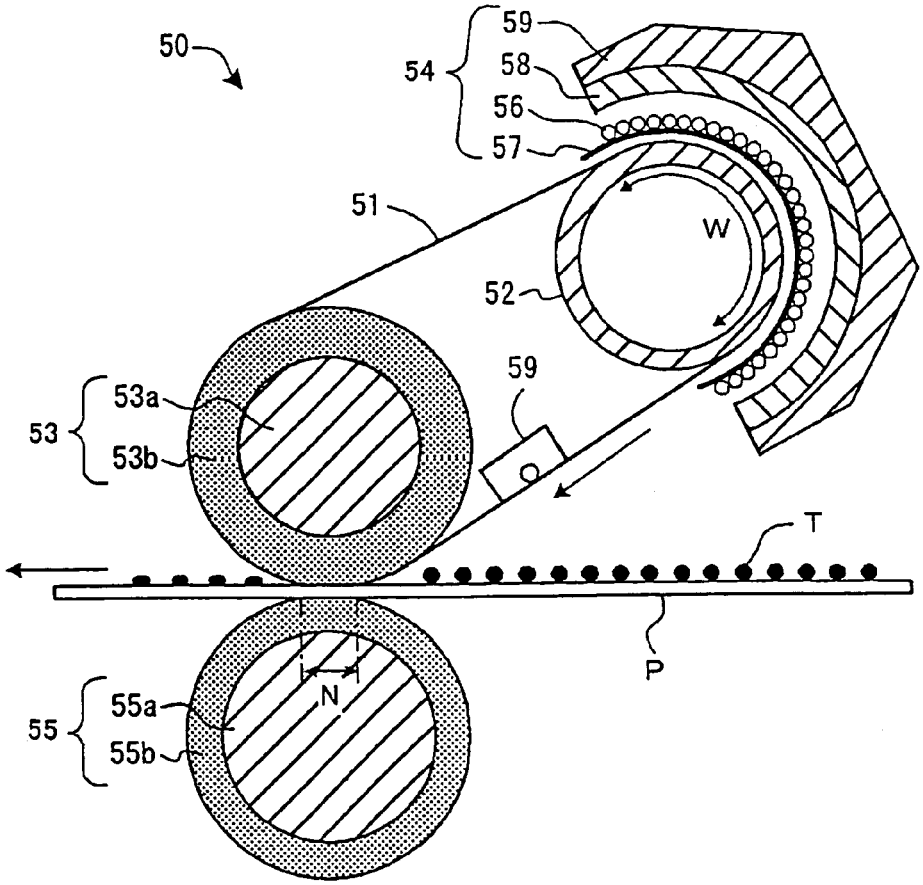
FIG. 2 is a cross-sectional view of a structure of main components of a fixing unit according to a first embodiment of the present invention.

FIG. 2 is a cross-sectional view of a structure of main components of a fixing unit 50 according to a first embodiment of the present invention. The fixing unit 50 includes a fixing belt 51, a heating roller 52, a fixing roller 53, an induction-heating unit 54, and a pressurizing roller 55. The fixing belt 51 is stretched over the heating roller 52 and the fixing roller 53 and is heated via the heating roller 52 that is heated by the induction-heating unit 54. The fixing belt 51 is an endless heat resistant belt that is rotated in a counter-clockwise direction as shown by an arrow, by rotation of either the heating roller 52 or the fixing roller 53. The pressurizing roller 55 is in a pressed contact with the fixing roller 53 via the fixing belt 51, and is driven and rotated by the fixing roller 53.

The heating roller 52 is made of a hollow circular cylindrical magnetic metal member of a metal such as iron and cobalt or an alloy of such metals. A diameter of the heating roller is in a range of 20 mm to 40 mm, a thickness is in a range of 0.3 mm to 1.0 mm, and has a structure that has low heat capacity, and its temperature rises quickly.

The fixing roller 53 includes a core 53*a* made of a metal such as stainless steel, which is coated by an elastic member 53*b*. The elastic member 53*b* includes heat resistant silicone rubber in a solid form or in the form of foam. The fixing roller 53 is let to be bigger than the heating roller 55 by letting an outer diameter to be in a range of 20 mm to 40 mm for forming a contact portion that has a predetermined width, between the pressurizing roller 55 and the fixing roller 53, by a thrust exerted by the pressurizing roller 55. A thickness of the elastic member 53*b* is in a range of 4 mm to 6 mm and a hardness of the elastic member 53*b* is in a range of 10 Asker to 50 Asker (Asker hardness).

Since a heat capacity of the heating roller 52 is less than a heat capacity of the fixing roller 53, the heating roller 52 is heated rapidly and a warm-up time becomes short. The fixing belt 51 that is stretched over the heating roller 52 and the fixing roller 53 is heated at a contact portion W with the heating roller 52 that is heated by the induction-heating unit 54. An inner surface of the fixing belt 51 is heated continuously by rotation of the heating roller 52 and the fixing roller 53, and as a result of this, the entire fixing belt 51 is heated.

Thus, the fixing belt 51 has a structure that includes a heat generating layer, an intermediate layer (elastic layer), and a releasing layer (outer layer). It is desirable that a thickness of the releasing layer is in a range of 10 μm to 300 μm, and the thickness of 200 μm is particularly desirable. With such a structure, since a toner image T formed on the paper P is rolled sufficiently on the outer layer portion of the fixing belt 51, the toner image T can be heated and fused uniformly. To ensure an abrasion resistance with lapsing of time, it is necessary that the releasing layer on an outer surface is at least 10-μm thick. Moreover, if the thickness of the releasing layer is greater than 300 μm, the heat capacity of the belt becomes bigger and the warm-up time becomes longer. Furthermore, during fixing of the toner, a temperature of the surface of the belt is hard to go down and the toner that is fused at an outlet of the fixing portion cannot be coagulated. Therefore, there is a decline in a release ability of the belt and the toner is adhered to-the belt, thereby causing the so called hot offset. As a substrate material of the fixing belt 51, instead of the heat generating layer formed by the metal, a heat resistant resin layer formed by a resin such as a fluorine contained resin, a polyimide resin, a polyamide resin, a polyamide imide resin, a PEEK (polyether ether ketone)

resin, a PES (polyether sulfone) resin, and a PPS (polyphenylene sulfide) resin may be used.

The pressurizing roller 55 includes a core 55*a* and an elastic member 55*b* provided on the core 55*a*. The core 55*a* is a circular cylindrical member made of a metal that has high thermal conductivity, such as copper or aluminum. The elastic member 55*b* has high toner release ability. Stainless steel may also be used apart from the metals mentioned above for the core 55*a*. The pressurizing roller 55 is in a pressed contact with the fixing roller 53 via the fixing belt 51, thereby forming a fixing nip N. In the first embodiment, by letting the hardness of the pressurizing roller 55 to be more than that of the fixing roller 53, the pressurizing roller 55 is pressed by the fixing roller 53 (and the fixing belt 51) forming a dent on the pressurizing roller 55. Due to the dent formed, since the paper P runs, along a peripheral shape of a surface of the pressurizing roller 55, the paper P is released easily from a surface of the fixing belt 51. An outer diameter of the pressurizing roller 55 is in a range of 20 mm to 40 mm, which is same as that of the fixing roller. However, a thickness of the elastic layer is less than that of the fixing roller 53 and is in a range of 0.5 mm to 2.0 mm. A hardness of the pressurizing roller 55 is in a range of 80 Asker to 100 Asker (Asker hardness), and is more than that of the fixing roller 53.

As a thermal insulating structure of the fixing roller 53 or the pressurizing roller 55, a hollow thread and hollow particles are filled in a foamed silicone rubber or in the silicone layer to improve the rate of air content thereby enabling to improve the air thermal-insulating effect. Moreover, the structure of the silicone layer filled with the hollow thread and the hollow particles has a greater surface hardness of the roller, a smaller compression permanent set, and can be used as a roller to drive the fixing belt 51.

The induction-heating unit 54 that heats the heating roller 52 by electromagnetic induction includes an exciting coil 56, which is a magnetic field generating unit and a coil guide plate 57 on which the exciting coil 56 is wound. The coil guide plate 57 is a semi-cylindrical shaped guide that is spaced closely from an outer peripheral surface of the heating roller 52. The exciting coil 56 is one continuous long exciting coil wire that is wound alternately in an axial direction of the heating roller along the coil guide plate 57. Moreover, the exciting coil 56 is connected to a driving power supply (not shown in the diagram) that has a frequency variable oscillation circuit. A semi-cylindrical shaped exciting coil core 58 made of a ferromagnetic material such as ferrite is spaced closely from the exciting coil 56 and is fixed to a core supporting member 59. According to the first embodiment, the exciting coil core 58 has a relative magnetic permeability 2500. A high frequency alternating current in a range of 10 kHz to 1 MHz, desirably in a range of 20 kHz to 800 kHz is supplied to the exciting coil 56 from the driving power supply and an alternating magnetic field is generated.

At the contact portion W of the heating roller 52 and the heat resistant fixing belt 51, and in an area near the contact portion W, the alternating magnetic field acts as the heat generating layer of the heating roller 52 and the fixing belt 51 and eddy current [I] flows in a direction that hinders change in the alternating magnetic field inside. The eddy current [I] generates Joule's heat according to a resistance of the heat generating layer of the fixing belt 51 and the heating roller 52 and the heating roller 52 and the fixing belt 51 that has the heat generating layer are heated by electromagnetic induction in mainly the contact portion W of the heating roller 52 and the fixing belt 51 and the area near the contact portion W. Thus, a temperature of the inner surface of the fixing belt 51 that is heated, is detected by a temperature detecting unit 59 that includes a thermo sensitive element that has high thermal response, such as a thermistor that is disposed such that it is in contact with the inner surface side of the fixing belt 51 in an area near an inlet of the fixing nip N.

Figure 3:
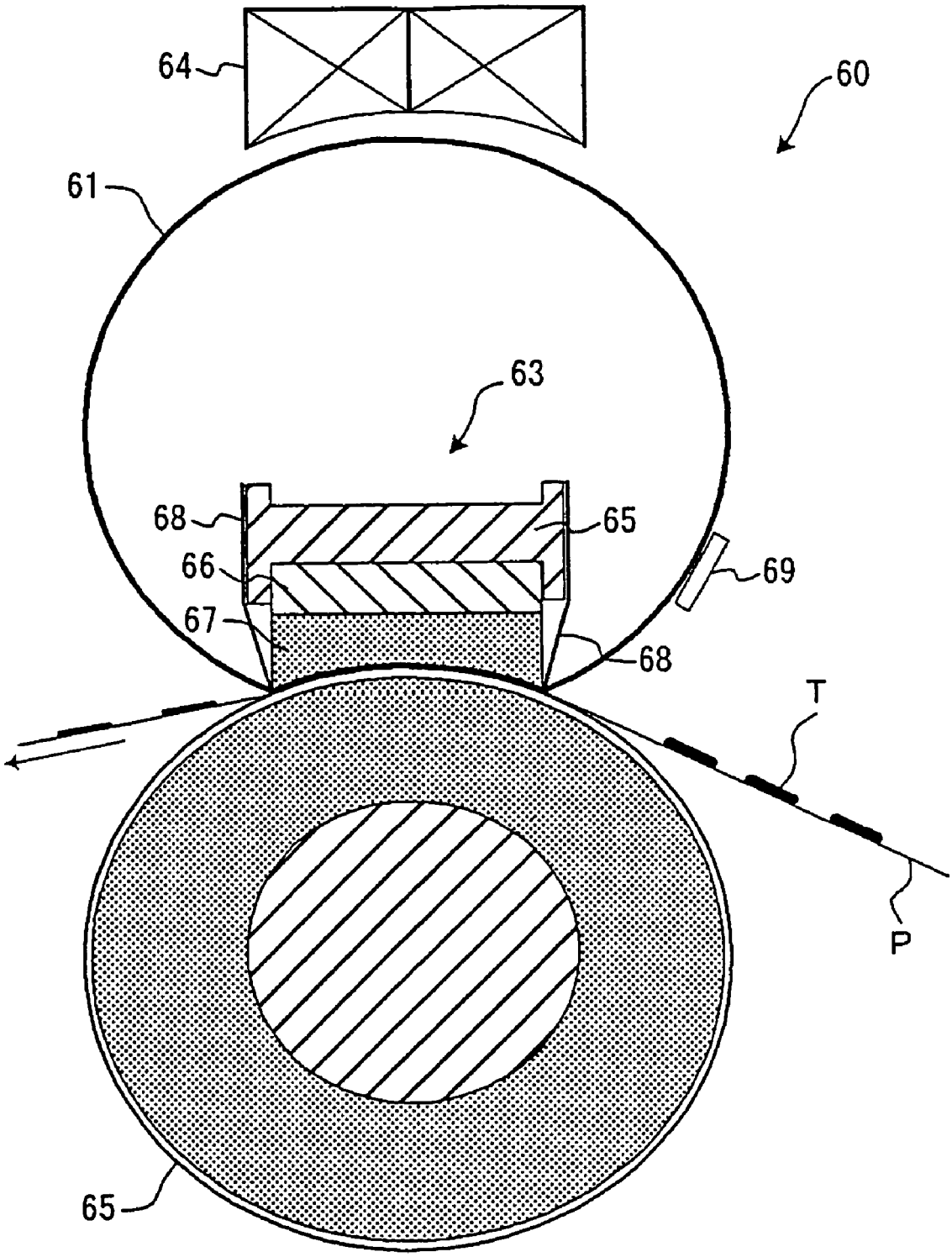
FIG. 3 is a cross-sectional view of a structure of main components of a fixing unit according to a second embodiment of the present invention.

FIG. 3 is a cross-sectional view of a structure of main components of a fixing unit according to a second embodiment of the present invention. A fixing unit 60 shown in this diagram includes a fixing belt 61, a fixing thrust member 63, an induction-heating unit 64, and a pressurizing member 65, which are accommodated in a fixing casing that is not shown in the diagram. The fixing belt 61 is similar to the fixing belt 51 according to the first embodiment and has at least a releasing layer that has a thickness not greater than 40 μm and a heat generating layer that has a thickness not less than 10 μm. According to the second embodiment, the heat capacity of the fixing belt 61 is in a range of 0.017 $J/K \cdot cm^2$ to 0.077 $J/K \cdot cm^2$. The fixing belt 61 is guided by guiding members that are not shown in the diagram, which are disposed at both ends in a cylindrical axial direction (a direction perpendicular to a surface of the diagram) so that the fixing belt 61 maintains roughly a cylindrical shape during rotation.

The fixing thrust member 63 includes a holder 65 that is a supporting member, an insulating member 66, a heat resistant elastic member 67, and a protective sheet 68. The fixing thrust member 63 is fixed and does not rotate. The fixing thrust member 63 is disposed facing a pressurizing roller 65, which is a pressurizing member, such that the heat resistant elastic member 67 is in contact with the fixing belt 61 via the protective sheet 68. The fixing thrust member 63 is pressed with a constant welding force against the pressurizing roller 65 with the fixing belt 61 sandwiched between the two. In other words, a fixing nip is formed by a pressed contact between the heat resistant elastic member 67 and the pressurizing roller 65 of the fixing thrust member, via the fixing belt 61.

The pressurizing roller 65 includes a core on which a hard foam layer is provided and the hardness of the pressurizing roller 65 is greater than the hardness of the (heat resistant elastic member 67 of the) fixing thrust member 63. The pressurizing roller 65 is driven and rotated in a counter-clockwise direction by a drive mechanism that is not shown in the diagram. As the pressurizing roller 65 rotates, the fixing belt 61 is rotated in a clockwise direction in the diagram. In a structure according to the second embodiment, it is desirable to rotate the fixing belt by a transmission of drive from the pressurizing roller 65.

The pressurizing roller 65 according to the present invention has the insulating structure that includes the core on which the hard foam layer is provided. As the thermal insulating structure, the foamed silicone rubber or the silicone layer filled with the hollow thread and the hollow particles is used. Such a thermal insulating structure improves the rate of air content, thereby enabling to improve the air thermal-insulating effect. The structure of the silicone layer filled with the hollow thread and the hollow particles has a greater surface hardness of the roller, a smaller compression permanent set, and is suitable to be used as a roller to drive the fixing belt 61.

The fixing thrust member 63 is protected by the protective sheet 68 that is provided such that it covers from a side surface of one of sides of the holler 65, then turning around a bottom surface of the heat resistant elastic member 67 up to a side surface of another side of the holler 65. When the fixing belt 61 rotates, an inner peripheral surface rotates while performing friction sliding with the protective sheet 68. By letting the protective sheet 68 to be a heat resistant film material that has low friction and excellent sliding property, it is possible to reduce a sliding resistance during the rotation of the belt. By reducing the sliding resistance between the fixing belt 61 and (the heat resistant elastic member 67 of) the fixing thrust member 63, it is possible to prevent a slip of the fixing belt 61 that is driven and rotated by the pressurizing roller 65. Moreover, it is also useful for preventing friction of the heat resistant elastic member 67.

Materials such as PI (polyimide), glass fiber, PIA (polyimide amide), PES (polyether sulfone), and PEEK (polyether ether ketone) can be used as a material for the protective sheet 68. The protective sheet 68 may also be coated by a material that includes a fluorine contained resin of these materials.

In the fixing unit 60 that has such a structure, by allowing a recording paper P that holds an unfixed toner image T, to pass through the fixing nip that is formed by a pressed contact between the fixing belt 61 and the pressurizing roller 65 by the fixing thrust member 63, the unfixed toner is fixed on the recording paper P due to heat and pressure. A temperature detecting unit 69 such as a thermistor is provided such that it is in contact with or near the outer peripheral surface of the fixing belt 61. Based on a temperature of the fixing belt 61 that is detected by the temperature detecting unit 69, an output of the induction-heating unit 64 is controlled.

Figure 4:
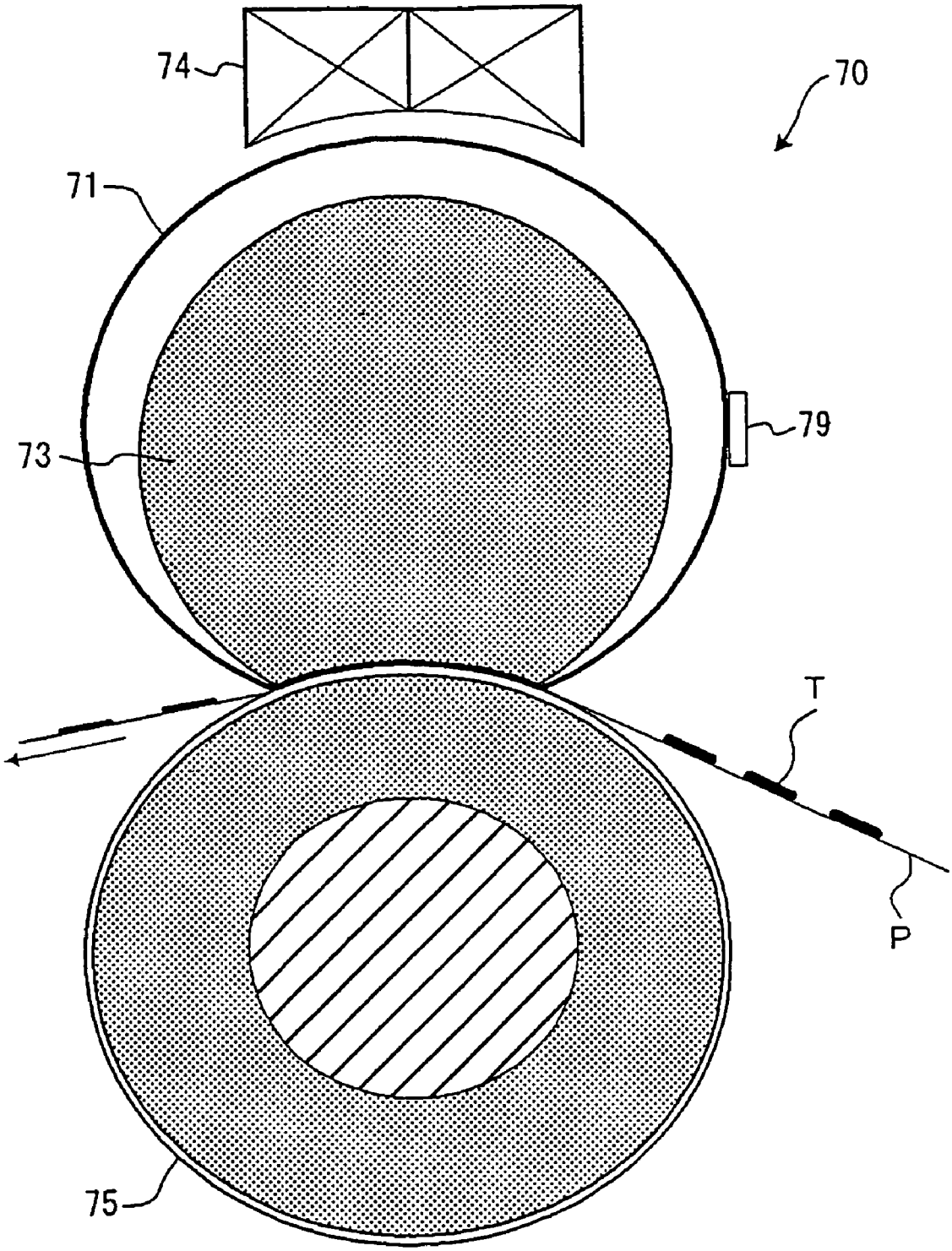
FIG. 4 is a cross-sectional view of a structure of main components of a fixing unit according to a third embodiment of the present invention.

FIG. 4 is a cross-sectional view of a structure of main components of a fixing unit according to a third embodiment of the present invention. A fixing unit 70 shown in this diagram includes a fixing belt 71, a fixing thrust member 73, an induction-heating unit 74, and a pressurizing member 75, which are accommodated in a fixing case that is not shown in the diagram. The fixing thrust member 73 is an elastic foamed roller. The fixing unit 70 has a structure similar to the fixing unit 60 according to the second embodiment except for the fixing thrust member 73, which is an elastic foamed roller that rotates. According to the third embodiment, the hardness of the pressurizing member 75 is greater than the hardness of the fixing thrust member 73, which is an elastic foamed roller.

Figure 5:
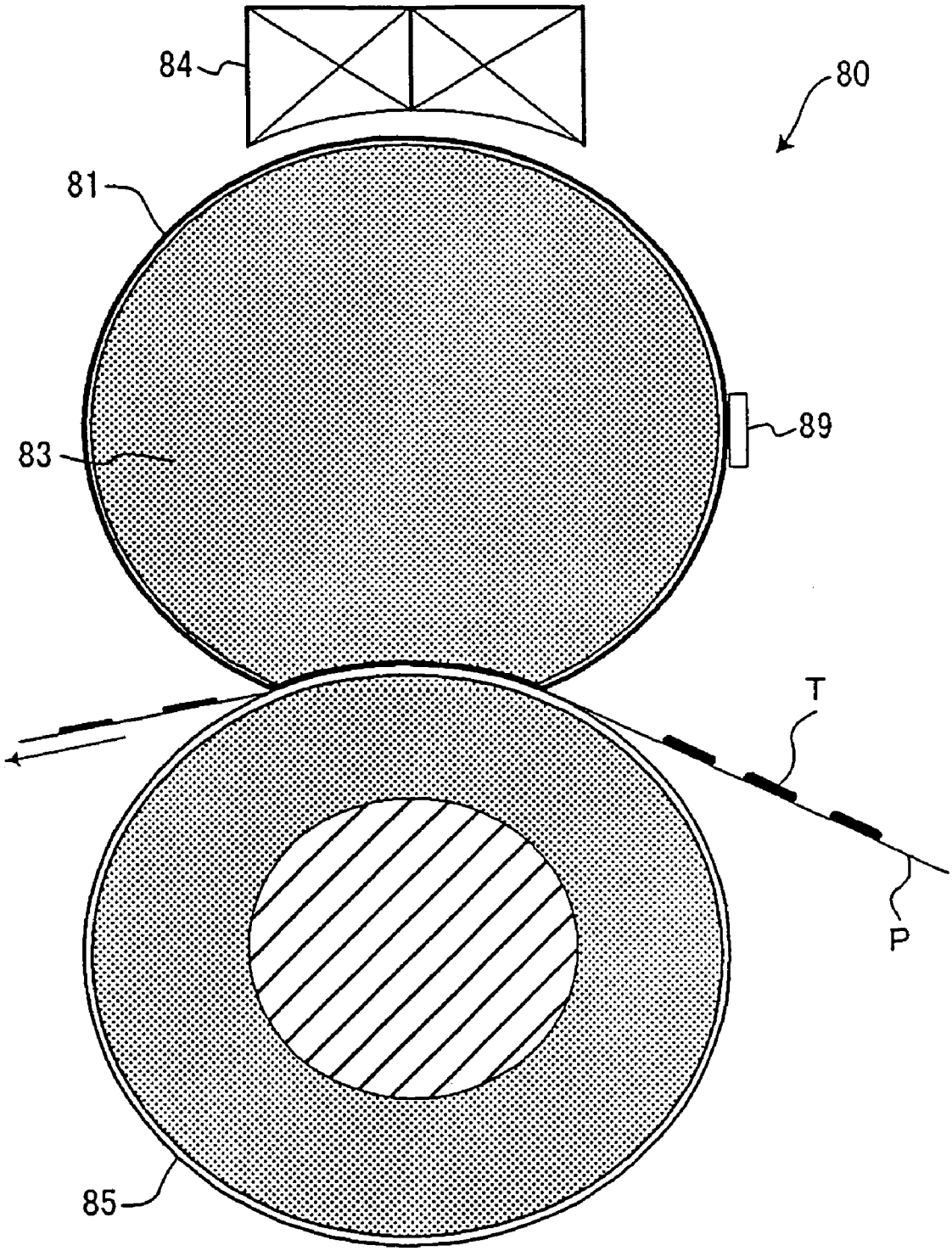
FIG. 5 is a cross-sectional view of a structure of main components of a fixing unit according to a fourth embodiment of the present invention.

FIG. 5 is a cross-sectional view of a structure of main components of a fixing unit according to a fourth embodiment of the present invention. According to a fixing unit 80 shown in this diagram, a diameter of a fixing thrust member 83, which is an elastic foamed roller is roughly the same as that of a pressurizing roller 85. The fixing unit 80 is the same as the fixing unit 70 according to the third embodiment except for a fixing belt 81 that is stretched around a periphery of the fixing thrust member 83. According to the fourth embodiment, the hardness of the pressurizing roller 85 is greater than the hardness of the fixing thrust member 83, which is an elastic foamed roller.

In the fixing units according to the second to fourth embodiments, a belt similar to the fixing belt 51 described in the first embodiment is used as a fixing belt. Moreover, by letting the hardness of the pressurizing member to be greater than that of the fixing member (fixing thrust member), a wide nip width can be achieved, a low temperature (temperature lower than that used so far) fixing becomes possible, and the start-up time of the fixing unit can be shortened.

Next, toner that is used in the fixing units according to the embodiments described so far is described. In a description that follows, all amounts are in parts by weight.

Toner No. 1

Polyester resin (polyester obtained by coagulating fumaric acid, terephthalic acid, polyethylene glycol, EO (ethoxylated) bisphenol A, and PO adduct): 100 parts by weight, carbon black (#44 manufactured by MITSUBISHI CARBON CORPORATION): 8 parts by weight, carnauba wax: 5 parts by weight, a compound of a metal salt of salicylic acid: 3 parts by weight After mixing a mixture having such a composition by stirring sufficiently in a Henschel mixer, it was heated and fused for approximately 30 minutes at a temperature in a range of 130° C. to 140° C. in a roll mill, and then cooled down to a room temperature. A kneaded mixture that was obtained was pulverized and classified in a jet mill, and a toner with a weight average particle size 6.0 μm was obtained (toner No. 1). The glass transition temperature of this toner was 48.5° C. and the outflow-start temperature of the toner was 102.3° C. The peak molecular weight of the toner was 6500. For 3 parts by weight of this toner, 100 parts by weight of a silicon resin solution (KR251 manufactured by SHIN-ETSU SILICONES) and 100 parts by weight of toluene were dispersed in a homomixer to prepare a solution that forms a coating layer. This solution that forms the coating layer was mixed with 97 parts by weight of a carrier that has a coating layer formed on a surface of 1000 parts by weight of spherical ferrite with an average particle size 50 μm, in a ball mill and a developer was obtained (developer 1).

Toner No. 2

Polyester resin (polyester obtained by coagulating trimellitic acid, terephthalic acid, polyethylene glycol, EO bisphenol A, PO adduct): 100 parts by weight, carbon black (#44 manufactured by MITSUBISHI CARBON CORPORATION): 8 parts by weight, ester wax: 5 parts by weight, a compound of a metal salt of salicylic acid: 3 parts by weight.

After mixing a mixture having such a composition by stirring sufficiently in the Henschel mixer, it was heated and fused for approximately 30 minutes at a temperature in the range of 130° C. to 140° C. in the roll mill, and then cooled down to the room temperature. A kneaded mixture that was obtained was pulverized and classified in the jet mill, and a toner with a weight average particle size 5.5 μm was obtained (toner No. 2). The glass transition temperature of this toner was 45.5° C. and the outflow-start temperature of the toner was 105.3° C. The peak molecular weight of the toner was 7500. For 3 parts by weight of this toner, 100 parts by weight of the silicon resin solution (KR251 manufactured by SHIN-ETSU SILICONES) and 100 parts by weight of toluene were dispersed in the homomixer to prepare a solution that forms the coating layer. This solution that forms the coating layer was mixed with 97 parts by weight of a carrier that has a coating layer formed on surface of 1000 parts by weight of the spherical ferrite with an average particle size 50 μm, in a ball mill and a developer was obtained (developer 2).

Toner No. 3

Polyester resin (polyester obtained by coagulating trimellitic acid, terephthalic acid, polyethylene glycol, EO bisphenol A, PO adduct): 100 parts by weight, carbon black (#44 manufactured by MITSUBISHI CARBON CORPORATION): 8 parts by weight, carnauba wax: 5 parts by weight, a compound of a metal salt of salicylic acid: 3 parts by weight.

After mixing a mixture having such a composition by stirring sufficiently in the Henschel mixer, it was heated and fused for approximately 30 minutes at a temperature in the range of 130° C. to 140° C. in the roll mill, and then cooled down to the room temperature. A kneaded mixture that was obtained was pulverized and classified in a jet mill and a toner with a weight average particle size 6.5 μm was obtained (toner No. 3). The glass transition temperature of this toner was 41.5° C. and the outflow-start temperature of the toner was 94.6° C. The peak molecular weight of the toner was 4000. For 3 parts by weight of this toner, 100 parts by weight of the silicon resin solution (KR251 manufactured by SHIN-ETSU SILICONES) and 100 parts by weight of toluene were dispersed in the homomixer to prepare a solution that forms the coating layer. This solution that forms the coating layer was mixed with 97 parts by weight of the carrier that has a coating layer formed on surface of 1000 parts by weight of the spherical ferrite with an average particle size 50 μm, in the ball mill and a developer was obtained (developer 3).

Toner example 1 for comparison (an example in which the outflow-start temperature is below that of toner No. 1 and No. 2)

Polyester resin (polyester obtained by coagulating fumaric acid, terephthalic acid, polyethylene glycol, and EO adduct of bisphenol A): 100 parts by weight, carbon black (#44 manufactured by MITSUBISHI CARBON CORPORATION): 8 parts by weight, carnauba wax: 5 parts by weight, a compound of a metal salt of salicylic acid: 3 parts by weight.

After mixing a mixture having such a composition by stirring sufficiently in the Henschel mixer, it was heated and fused for approximately 30 minutes at a temperature in the range of 130° C. to 140° C. in the roll mill, and then cooled down to the room temperature. The kneaded mixture that was obtained was pulverized and classified in the jet mill, and a toner with a weight average particle size 6.0 μm was obtained (toner example 1 for comparison). The glass transition temperature of this toner was 43.5° C. and the outflow-start temperature of the toner was 78.2° C. The peak molecular weight of the toner was 4200. For 3 parts by weight of this toner, 100 parts by weight of the silicone resin solution (KR251 manufactured by SHIN-ETSU SILICONES) and 100 parts by weight of toluene were dispersed in the homomixer to prepare a solution that forms the coating layer. This solution that forms the coating layer was mixed with 97 parts by weight of a carrier that has the coating layer formed on the surface of 1000 parts by weight of spherical ferrite with an average particle size 50 μm, in the ball mill and a developer was obtained (developer 1 for comparison).

Toner example 2 for comparison (an example in which the outflow-start temperature is above that of toner No. 1 and No. 2)

Polyester resin (polyester obtained by coagulating trimellitic acid, terephthalic acid, polyethylene glycol, and PO adduct of bisphenol A): 100 parts by weight, carbon black (#44 manufactured by MITSUBISHI CARBON CORPORATION): 8 parts by weight, carnauba wax: 5 parts by weight, and a compound of a metal salt of salicylic acid: 3 parts by weight.

After mixing a mixture having such a composition by stirring sufficiently in the Henschel mixer, it was heated and fused for approximately 30 minutes at a temperature in the range of 130° C. to 140° C. in the roll mill, and then cooled down to the room temperature. The kneaded mixture that was obtained was pulverized and classified in the jet mill, and a toner with a weight average particle size 6.0 μm was obtained (toner example 2 for comparison). The glass transition temperature of this toner was 48.5° C. and the outflow-start temperature of the toner was 112.2° C. The peak molecular weight of the toner was 8500. For 3 parts by weight of this toner, 100 parts by weight of the silicone resin solution (KR251 manufactured by SHIN-ETSU SILICONES) and 100 parts by weight of toluene were dispersed in the homomixer to prepare a solution that forms the coating layer. This solution that forms the coating layer was mixed with 97 parts by weight of a carrier that has the coating layer formed on the surface of 1000 parts by weight of spherical ferrite with an average particle size 50 μm, in the ball mill and a developer was obtained (developer 2 for comparison).

Toner example 3 for comparison (an example in which the glass transition temperature is below that of toner No. 1 and No. 2)

Polyester resin (polyester obtained by coagulating fumaric acid, polyethylene glycol, and EO adduct of bisphenol A): 100 parts by weight, carbon black (#44 manufactured by MITSUBISHI CARBON CORPORATION): 8 parts by weight, carnauba wax: 5 parts by weight, and a compound of a metal salt of salicylic acid: 3 parts by weight.

After mixing a mixture having such a composition by stirring sufficiently in the Henschel mixer, it was heated and fused for approximately 30 minutes at a temperature in the range of 130° C. to 140° C., and then cooled down to the room temperature. The kneaded mixture that was obtained was pulverized and classified in the jet mill, and a toner with a weight average particle size 6.0 μm was obtained (toner example 3 for comparison). The glass transition temperature of this toner was 33.5° C. and the outflow-start temperature of the toner was 98.2° C. The peak molecular weight of the toner was 5200. For 3 parts by weight of this toner, 100 parts by weight of the silicone resin solution (KR251 manufactured by SHIN-ETSU SILICONES) and 100 parts by weight of toluene were dispersed in the homomixer to prepare a solution that forms the coating layer. This solution that forms the coating layer was mixed with 97 parts by weight of the carrier that has a coating layer formed on the surface of 1000 parts by weight of spherical ferrite with an average particle size 50 μm, in the ball mill and a developer was obtained (developer 3 for comparison).

Toner example 4 for comparison (an example in which the glass transition point is above that of toner No. 1 and No. 2)

Polyester resin (polyester obtained by coagulating trimellitic acid, terephthalic acid, polyethylene glycol, and EO adduct of bisphenol A): 100 parts by weight, carbon black (#44 manufactured by MITSUBISHI CARBON CORPORATION): 8 parts by weight, carnauba wax: 5 parts by weight, and a compound of a metal salt of salicylic acid: 3 parts by weight.

After mixing a mixture having such a composition by stirring sufficiently in the Henschel mixer, it was heated and fused for approximately 30 minutes at a temperature in the range of 130° C. to 140° C., and then cooled down to the room temperature. The kneaded mixture that was obtained was pulverized and classified in the jet mill, and a toner with a weight average particle size 6.0 μm was obtained (toner example 4 for comparison). The glass transition temperature of this toner was 53.5° C. and the outflow-start temperature of the toner was 103.6° C. The peak molecular weight of the toner was 6600. For 3 parts by weight of this toner, 100 parts by weight of the silicone resin solution (KR251 manufactured by SHIN-ETSU SILICONES) and 100 parts by weight of toluene were dispersed in the homomixer to prepare a solution that forms the coating layer. This solution that forms the coating layer was mixed with 97 parts by weight of the carrier that has the coating layer formed on the surface of 1000 parts by weight of spherical ferrite with an average particle size 50 μm, in the ball mill and a developer was obtained (developer 4 for comparison).

The fixity of the toners-was judged by a lower limit temperature for fixing. An experiment to measure the lower limit temperature for fixing was carried out as follows.

By using the experiment equipment, a copy test was performed by setting a paper of type 6200 manufactured by RICOH COMPANY LIMITED. A fixing roller temperature at which a survival rate of image density upon rubbing a fixed image by using a pad is not less than 70% is let to be the lower limit temperature for fixing. Moreover, if the fixing temperature is raised up, due to excessive fusion of the toner, all the toner is remained on the fixing belt without being fixed on a transfer material such as a paper. This remained toner adheres to a non-image area, thereby giving rise to the so called offset phenomenon. A range of fixing temperature indicates a range from a lower limit temperature for fixing to-an upper limit temperature at which no offset phenomenon occurs. From a practical use point of view, it is desirable that the lower limit temperature for fixing is not higher than 140° C. and the range of fixing temperature is not less than 60° C.

A judgment by each toner mentioned above is shown in table 3.

TABLE 3

| Toner No. | Lower limit temperature for fixing (° C.) | Upper limit temperature for fixing (Range of fixing temperature ° C.) | Evaluation |
|---|---|---|---|
| Toner No. 1 | 130 | 200 (70) | Appropriate |
| Toner No. 2 | 135 | 210 (75) | Appropriate |
| Toner No. 3 | 125 | 190 (65) | Appropriate |
| Toner 1 for comparison | 125 | 140 (15) | Not appropriate |
| Toner 2 for comparison | 165 | 245 (80) | Not appropriate |
| Toner 3 for comparison | 130 | 150 (20) | Not appropriate |
| Toner 4 for comparison | 160 | 225 (65) | Not appropriate |

Regarding evaluation of the-toners, from the point of view mentioned above, the toner that has the lower limit temperature for fixing not higher than 140° C., the upper limit temperature for fixing not higher than 220° C., and the range of fixing temperature not lower than 60° C. was judged to be good. The low lower limit temperature for fixing is suitable from the point of view of start-up time, energy conservation, and fixity. Moreover, the low upper limit temperature for fixing is suitable from the point of view of heat resistance and durability. Furthermore, a wide range of fixing temperature enables to deal with various types of paper and the defective fixing and offset cannot occur easily.

In a relationship of data of the heat capacity of belt shown in table 2 and data of the toner evaluation shown in table 3, regarding the start-up time, by using the toner No. 2 that has a high melting point from among the toners from toner No. 1 to toner No. 3, an upper limit of the heat capacity of the belt is regulated in a range that satisfies the desired start-up time (not more than 30 seconds).

Similarly, regarding the offset, by using the toner No. 3 that has a low melting point from among the toners from toner No. 1 to toner No. 3, a lower limit of the heat capacity of the belt is regulated in a range in which the hot offset does not occur.

Thus, the fixing unit according to the present invention enables a low temperature fixing by widening sufficiently the fixing nip. Moreover, by using the fixing felt that has a low heat capacity and by insulating either one of or both of a pressurizing member and a fixing member, which form a nip with a fixing belt, with an appropriate combination of toners, both of a high speed and a conservation of energy can be achieved, and it is also possible to have an excellent fixity and to prevent the offset.

Particularly, if a pressurizing member that is an insulating roller that has a stiffness (a roller that has Asker hardness not less than 80) and that is harder than the fixing member, is used, the transferring of the fixing belt is stabilized, and since the fixing nip is formed in a direction in which the paper is not rolled around the belt, there is an improvement in the paper separation.

A fixing belt that is used according to the present invention is a low heat capacity belt that includes a heat generating layer of thickness not greater than 40 μm and a releasing layer of thickness not less than 10 μm. By using such a fixing belt having low heat capacity and by using a toner that includes at least a binder resin, a colorant, and a mold releasing agent, and that has the glass transition temperature in a range of 35° C. to 50° C. and the outflow-start temperature in a range of 80° C. to 110° C., it is possible to-achieve both the high speed start-up and the energy conservation, as well as to have an excellent fixity and the offset can be prevented.

Figure 6:
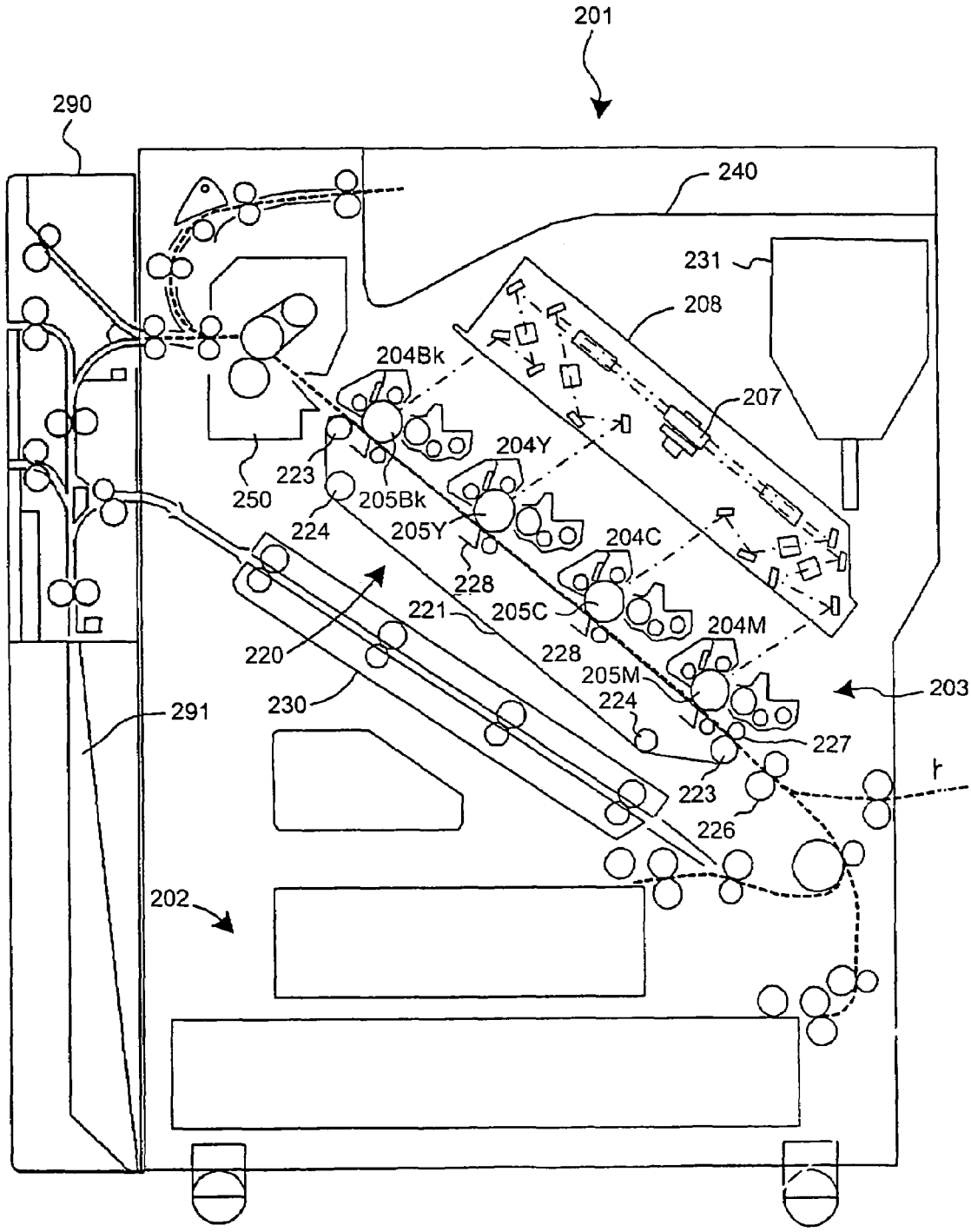
FIG. 6 is a schematic of an exemplary image forming apparatus in which the fixing units according to the present invention can be installed.

An example of an image forming apparatus in which the fixing unit according to the present invention can be installed, is described by referring to FIG. 6. The fixing unit described in the embodiments so far can be installed. In the diagram, an example in which the fixing unit 50 according to the first embodiment is used is shown and in FIG. 6 the fixing unit is let to be a fixing unit 250.

In a color laser printer 201 shown in FIG. 6, a paper feeder 202 is provided at a bottom of a main body and an image forming section 203 is disposed above the paper feeder 202. A paper discharge tray 240 is disposed at a top surface of the color laser printer 201. A paper transportation route is shown by dashed lines in the diagram. According to this route, a paper is fed from the paper feeder 202. An image that is formed by the image forming section 203 is transferred to the paper. The image transferred is fixed by the fixing unit 250 and the paper is discharged to the paper discharge tray 240. A bypass feeding (reference numeral h) of paper is possible from a side surface of the color laser printer 201.

A double-sided printing unit 290 is installed on a side surface of the color laser printer 201. The paper can be turned over upon fixing and can be re-fed via a double-sided transporting section 230. Moreover, from the double-sided printing unit 290, the paper can be discharged to a paper discharge tray on the side surface of the color laser printer 201 that is not shown in the diagram.

The image forming section 203 includes a transfer-carrier belt unit 220 that is inclined with its paper discharge side upward. Four image forming units 204M, 204C, 204Y, and 204Bk for magenta (M), cyan (C), yellow (Y), and black (Bk) colors respectively are disposed in a row running upward along a top running portion of the transfer-carrier belt unit 220.

Since each of the image forming units 204M, 204C, 204Y, and 204Bk have the same structure, the image forming units are indicated by alphabets (M, C, Y, and Bk) for the respective colors.

Each image forming unit 204 includes photosensitive drums 205 as an image carrier. Each of the photosensitive drums 205 is driven in a clockwise direction in a diagram by a drive unit that is not shown in the diagram. Units such as a charging roller, a developing unit, and a cleaning unit are disposed around each photosensitive drum 205. The charging unit in this example is a two-component developing unit that develops a two-component developer, which includes a toner and a carrier. Toner that is held on a developing roller is applied on the photosensitive drum 205. A laser beam from an optical writing unit 208 is irradiated on the photosensitive drum 205 through the charging roller and the developing roller.

A transfer-carrier belt 221 that is, the form of an endless loop is stretched over a driven roller 223 and a pair of rollers 224 facing one another. On an inner side of the transfer-carrier belt 221, a transfer brush 228 is disposed at a position facing the photosensitive drum 205 for each of the image forming units 204M, 204C, 204Y, and 204Bk, such that the brush is in contact with the transfer-carrier belt 221. A transfer bias is applied on the transfer brush 228. A paper absorbing roller 227 is disposed above the driven roller 223 sandwiching the transfer-carrier belt 221. A recording paper is fed to the transfer-carrier belt 221 through the driven roller 223 and the paper absorbing roller 227 and is attached electrostatically on the transfer-carrier belt 221 by a bias voltage that is applied on the paper absorbing roller 227.

In a case of a color print, the transfer-carrier belt 221 in the transfer-carrier belt unit 220 is held in contact with (the photosensitive drums of) the image forming units 204M, 204C, 204Y, and 204Bk for four-colors and in a case of a black single color print, the transfer-carrier belt 221 is held in contact with the photosensitive drum of) the image forming unit 204Bk only.

The following is a description of a printing operation.

In the image forming unit 204M for magenta color, a surface of the photosensitive drum 205 is charged uniformly to a predetermined potential by a charging roller 206. A laser beam is irradiated on a polygon mirror 207 by driving an LD (laser diode) that is not shown in the diagram, based on image data that is transmitted from a host machine such as a personal computer. Reflected light is guided to the photosensitive drum 205 via a cylinder lens, and an electrostatic latent image that is to be developed by magenta toner is formed on the photosensitive drum 205M. Toner is supplied to the electrostatic latent image from a developing unit 210 and it becomes a visualized image of magenta toner.

On the other hand, a paper that is designated as a transfer material is fed from the paper feeder 202, which strikes a registering roller 226 that is provided on an upstream side of a direction of transfer of the transfer-carrier belt unit 220. In the case of a color print, in the transfer-carrier belt unit 220, the transfer-carrier belt 221 is pushed up and the transfer-carrier belt 221 is in contact with (the photosensitive drums of) the image forming units 204M, 204C, 204Y, and 204Bk for four colors. The paper is sent on the transfer-carrier belt 221 such that it synchronizes with the visualized image and it reaches a position of transfer facing the photosensitive drum 205M due to the running of the transfer-carrier belt 221. At the position of transfer, the visualized image of magenta toner is transferred to the paper due to an action of the transfer brush 228 that is disposed on a rear surface side of the transfer-carrier belt 221.

Similarly as for the magenta color, in the image forming units 204C, 204Y, and 204Bk, visualized images for respective colors are formed on surfaces of the photosensitive drums 205. Every time the paper that is carried by the transfer-carrier belt 221 reaches the position of transfer, the visualized images are transferred and superimposed. Therefore, the color printer according to this embodiment can transfer and superimpose a full color image in a short time almost the same as that for a monochrome image.

On the other hand, in the case of monochrome print, in the transfer-carrier belt unit 220, the transfer-carrier belt 221 is lowered and (the photosensitive drum of) the image forming unit 204Bk only is in contact with the transfer-carrier belt 221. A visualized image for black toner is formed on a surface of the photosensitive drum 205 in the image forming unit 204Bk only for black color. A Bk toner image is transferred to a paper that is sent to the transfer-carrier belt 221 such that it synchronizes with the visualized image of black color.

The paper upon the toner image transferred on it is separated from the transfer-carrier belt 221 and the toner image is fixed by the fixing unit 250. The paper with the image fixed on it is either discharged to the paper discharge tray provided on the top surface of the color laser printer 201 or is forwarded to the double-sided printing unit 290.

The paper can be discharged from the double-sided printing unit 290 to the discharge tray on the side surface of the color laser printer 201, that is not shown in the diagram or can be turned over in the double-sided printing unit in a case of double-sided printing and re-fed to the image forming section 203 via the double-sided transporting section and an image can be formed on a back side of the paper. A paper with the images recorded on both sides is discharged either to the paper discharge tray 240 on the top surface of the color laser printer or the paper discharge tray of the double-sided printing unit.

The present invention is described by referring to the examples in the diagrams. However, the present invention is not restricted to these examples only. For example, a stiff roller that has thin surface and does not have an elastic layer (insulation structure) may be used as a pressurizing roller in the fixing units in the embodiments. A roller that has a thin surface with thickness not greater than 1 mm has small heat capacity, reduces heat conduction from a fixing belt to the pressurizing roller thereby reducing the heat loss, can improve a heating efficiency of the belt. Moreover, the fixing belt can also be stretched over a rotating roller and a non-rotating body.

The structure and material of the fixing belt, the fixing member, and the pressurizing member, and the composition of toner can be set appropriately within a scope of the present invention. The image forming apparatus need not necessarily be a printer. It may be a copying machine and a facsimile. A method of image forming is not restricted to the-electrophotographic method.

Other embodiments of the present invention are described with reference to accompanying diagrams.

Figure 7:
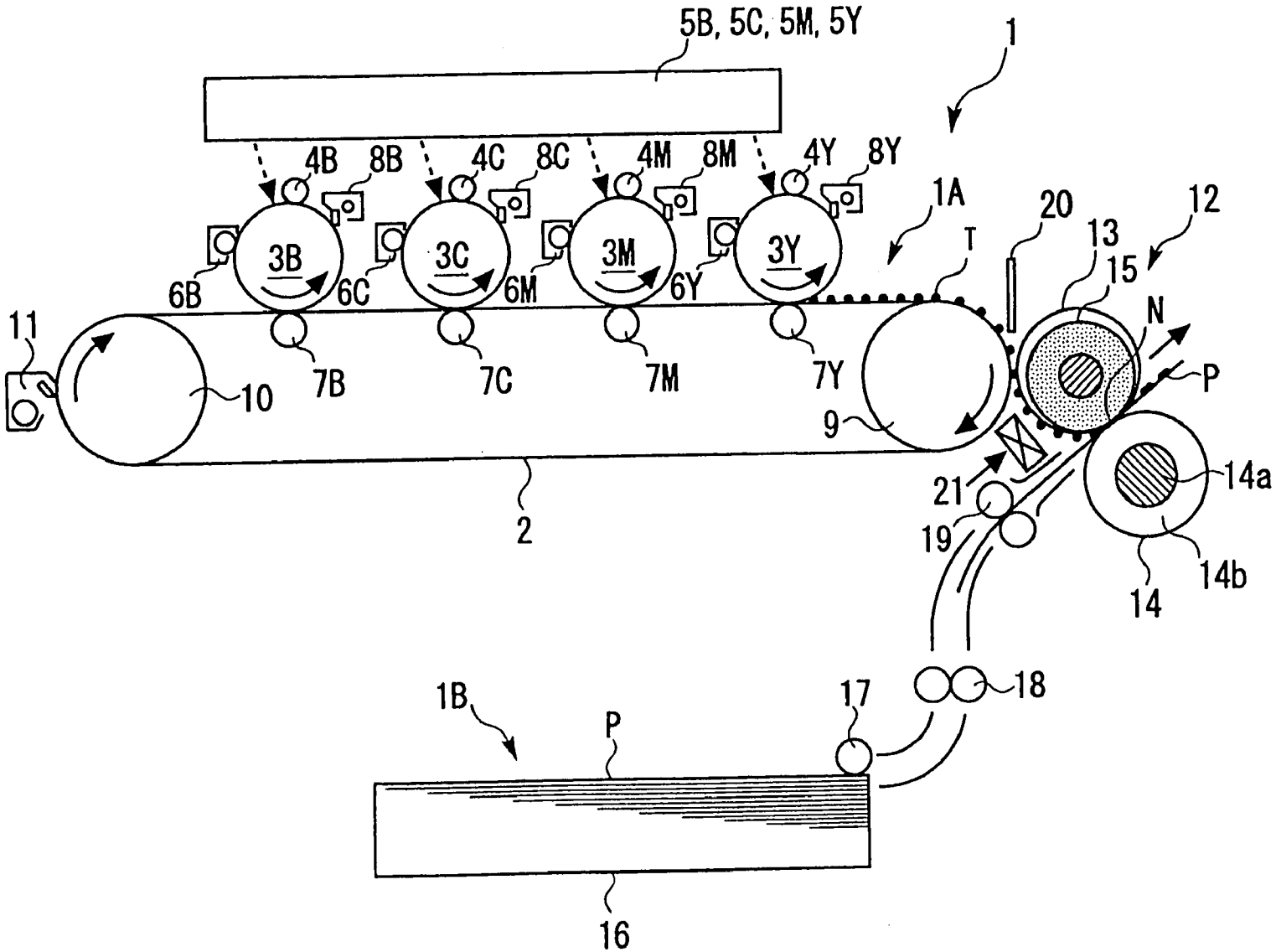
FIG. 7 is an enlarged view of an image forming unit and the fixing unit in the image forming apparatus shown in FIG. 6.

FIG. 7 is a diagram of an example of a structure of an image forming apparatus according to the present invention. This is a tandem color copying machine. A color copy machine 1 includes an image forming section 1A that is at a center of the color copy machine 1, a paper feeding section 1B that is beneath the image forming section, and an image reading section that is disposed above the image forming section 1A but not shown in the diagram. The image forming section 1A includes an intermediate transfer belt 2 as an intermediate transfer body that has a transfer surface, which extends in a horizontal direction. A structure to form an image of colors that are related as color-separated colors and complementary colors is provided on an upper surface of the intermediate transfer belt 2. In other words, photosensitive drums 3Y, 3M, 3C, and 3B are arranged in a row along a transfer surface of the intermediate transfer belt 2, as image carriers that can hold an image of toners of colors (yellow, magenta, cyan, and black) that are complementary colors.

Each of the photosensitive drums 3Y, 3M, 3C, and 3B includes a drum that can rotate in the same direction (counterclockwise direction). A charging unit 4, a writing unit 5 that is an optical writing unit, a developing unit 6, a primary transfer unit 7, and a cleaning unit 8 that perform image forming while rotating of the photosensitive drum, are provided around the photosensitive drums 3Y, 3M, 3C, and 3B. An alphabet that is added to each of the reference numerals corresponds to a color of the toner similarly as for the photosensitive drums 3. Each of the developing units 6 contains a toner of a respective color.

The intermediate transfer belt 2 is stretched over a drive roller 9 and a driven roller 10 and is structured such that it can move in the same direction at a position facing the photosensitive drums 3Y, 3M, 3C, and 3B. A cleaning unit 11 that cleans a surface of the intermediate transfer roller is disposed at a position facing the driven roller 10.

A surface of the photosensitive drum 3Y is charged uniformly by the charging unit 4 and an electrostatic latent image is formed on the photosensitive drum 3Y based on image information from the image reading section. The electrostatic latent image is visualized as a toner image by a developing unit 6Y that contains yellow toner and the toner image is subjected to primary transfer on the intermediate transfer belt 2 by a primary transfer unit 7Y on which a predetermined bias is applied. The same image forming is performed with toners of different colors for the other photosensitive drums 3M, 3C, and 3B. Toner images of respective colors are transferred to and superimposed on the intermediate transfer belt one after another. Toner that is remained on the photosensitive drums 3 after the transfer is removed by the respective cleaning units 8. Electric potential on the photosensitive drums 3 is initialized after the transfer by a decharging lamp that is not shown in the diagram and a preparation for the next image forming process is done.

A fixing unit 12 is provided near the drive roller 9. The fixing unit 12 forms a nip N (hereinafter, "nip" or "transfer nip") by a transferring and fixing belt 13, a fixing roller 15, and a pressurizing roller 14, with the transferring and fixing belt 13 sandwiched between the fixing roller 15 and the pressurizing roller 14. The transferring and fixing belt 13 is a transferring and fixing member to which an image on the intermediate transfer belt 2 that is an unfixed toner image is transferred. The transferring and fixing belt 13 includes a belt substrate provided with a heat generating layer, a surface of which is coated by a releasing layer. An induction heating source 21 that heats up an image on the transferring and fixing belt 13 is provided for the transferring and fixing belt 13.

The paper feeding section 1B includes a paper feeding tray 16, a paper feeding roller 17, a pair of transporting rollers 18, and a pair of registering rollers 19. The paper feeding tray 16 accommodates a pile of papers P. The paper feeding roller 17 separates and feeds one paper each from a paper at the top of the pile of papers P in the paper feeding tray 16. The transporting roller 18 carries the paper P that is fed from the paper feeding tray 16. The paper P stops for a while at the pair of registering rollers 19. After rectification of the inclined shift of the paper P, the pair of registering rollers 19 forwards the paper P towards the nip N such that a predetermined position in a direction of transporting of the paper P coincides with a front tip of the image on the transferring and fixing belt 13.

A toner image T (hereinafter, "toner") that is subjected to primary transfer to the intermediate transfer belt 2 from the photosensitive drums 3Y, 3M, 3C, and 3B is transferred secondarily by an electrostatic force to the transferring and fixing belt 13 by a bias (that includes superimposing of AC, pulse etc.) that is applied on the drive roller 9 by a bias applying unit that is not shown in the diagram.

The toner image T that is transferred to the transferring and fixing belt 13 from the intermediate transfer belt 2 is heated by the induction heating source 21 on the transferring and fixing belt till the toner image T is fixed on the paper P. Thus, with such a structure, since only the toner T can be heated sufficiently ahead of fixing, it is possible to lower the fixing temperature as compared to a conventional way of heating the toner T and the paper P simultaneously. As a result of an experiment, it was confirmed that a sufficiently appropriate image quality can be achieved even at a low temperature range from 80° C. to 120° C. of the transferring and fixing belt 13.

Thus, the fixing unit 12 according to this embodiment has a function of unfixed toner getting transferred and is positioned as a transferring and fixing unit unlike the conventional fixing unit that merely heats and pressurizes a paper that holds a unfixed toner image.

Figure 8:
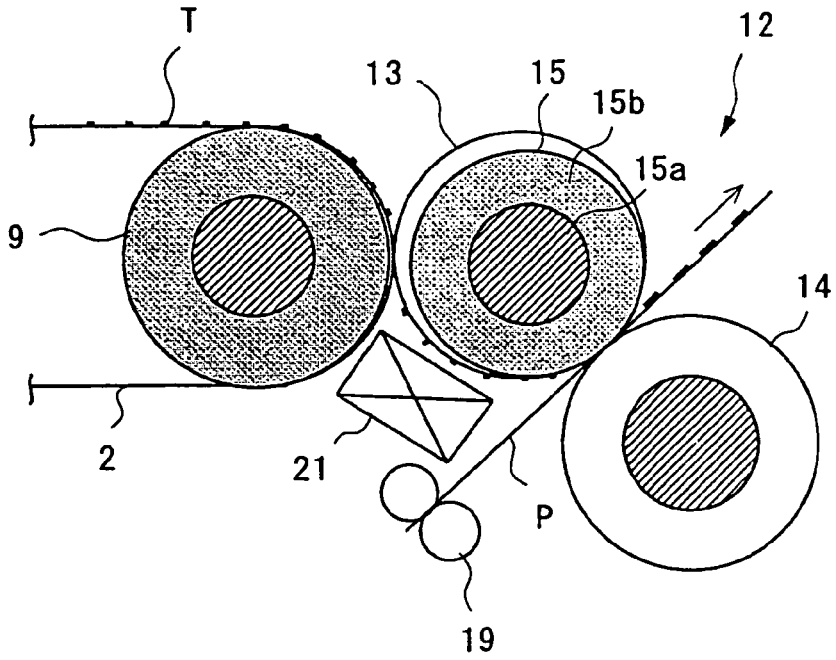
FIG. 8 is an enlarged view of the fixing unit shown in FIG. 7.

The following is a detailed description of the fixing unit 12. FIG. 8 is a front view of the fixing unit.

The fixing roller 15 includes a core 15*a* made of a metal such as stainless steel, which is coated by an elastic member 15*b*. The elastic member 15*b* includes heat resistant silicone rubber in solid form or in the form of foam. A thickness of the elastic member 15*b* is in a range of 4 mm to 6 mm and a hardness of the elastic member 15*b* is in a range of 10 degrees to 50 degrees (Asker hardness).

A portion where the intermediate transfer belt 2 and the transferring and fixing belt 13 that is stretched over the fixing roller 15, face one another is supported by a bias roller, which is a bias applying unit that applies bias on the intermediate transfer belt 2. A bias of the same polarity as that of the toner T is applied such that an electric field in which the toner T is absorbed electrostatically to the transferring and fixing belt 13 in the transfer nip N, is generated at the bias roller that is positioned at a position of transfer and an electrostatic repulsion is imparted to the toner.

The induction heating source 21 that heats the toner T on the transferring and fixing belt 13 includes an exciting coil that is a magnetic field generating unit, and a coil guide plate on which the exciting coil is wound. The exciting coil is connected to a driving power supply that has an oscillating circuit with a variable frequency. A high-frequency ac power in a range of 10 kHz to 1 MHz, desirably in a range of 20 kHz to 800 kHz is fed to the exciting coil from the driving power supply, thereby generating an alternating magnetic field. At a surface facing the transferring and fixing belt 13, the alternating magnetic field acts as a heat generating layer of the transferring and fixing belt 13, and eddy current flows in a direction that hinders change in the alternating magnetic field inside. The eddy current generates Joule's heat according to a resistance of the heat generating layer of the transferring and fixing belt 13 and heats the toner T on the transferring and fixing belt 13. Thus, since the toner T on the transferring and fixing belt 13 is heated directly, it is possible to start-up the unit instantaneously. The induction heating source 21 is desirable as it has high energy efficiency and an output can be changed by varying the frequency. Moreover, it is possible to perform the self temperature control in which the magnetic properties (Curie point) of the heated product are used and it is advantageous from the point of view of the safety of burning and ignition.

Figure 9:
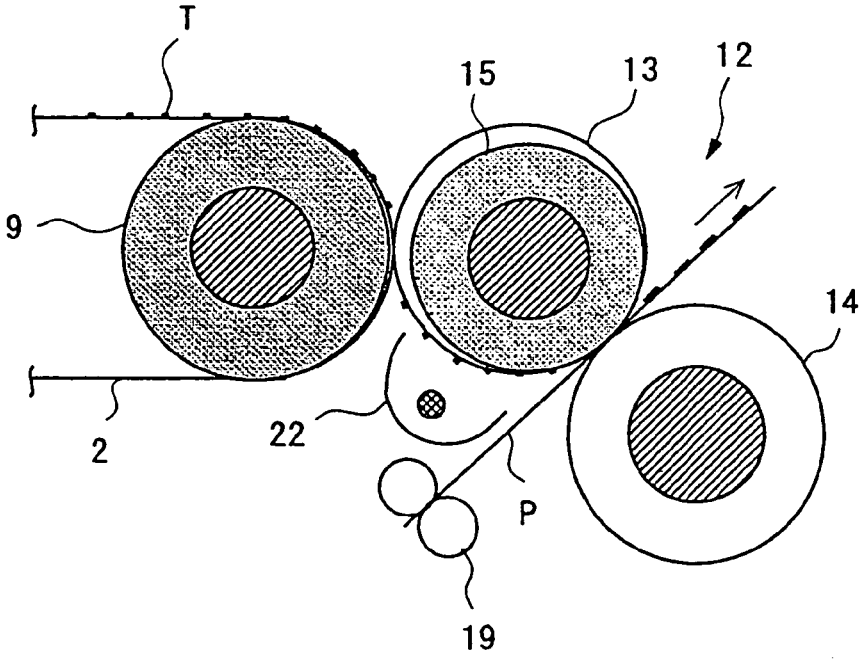
FIG. 9 is an enlarged view of a fixing unit according to still another embodiment of the present invention.

FIG. 9 is a diagram of a structure of another fixing unit. In FIG. 8, a unit for heating the toner T on the transferring and fixing belt 13 is the induction heating source 21, which can be a radiant heat source 22 as shown in FIG. 9. An example of the radiant heat source 22 is a halogen lamp. When toner is heated directly from a surface of the toner by the radiant heat source 22, an offset preventing effect is achieved. In other words, while transferring to and fixing on a paper by heating the surface of the toner for a long time, with an interfacial temperature between the transferring and fixing belt and the toner lower than an interfacial temperature between the paper and the toner, a small temperature gradient in the toner layer, and a uniform fusing are effective against the hot offset.

Moreover, by allowing either any one or both of the transferring and fixing belt 13 and the pressurizing roller 14 to have a thermal insulating structure, a heat loss can be reduced, a heating efficiency of the transferring and fixing belt 13 can be improved, and even more energy can be saved.

Particularly, it is desirable that the pressurizing roller 14 has the thermal insulating structure. Examples of the thermal insulating structure are a foamed silicone rubber or a silicone layer filled with the hollow thread and hollow particles that improve the rate of air content, thereby enabling to improve the air thermal-insulating effect. A hard porous roller has such a thermal insulating structure. By letting the hard porous roller to be the pressurizing roller, it is possible to have a greater surface hardness, a small compression set, and it can be used as a belt drive roller. A desirable hardness of the pressurizing roller is not less than 80 degree in Asker hardness.

Thus, by using the hard porous roller as the pressurizing roller 14 and making it harder than the transferring and fixing belt 13, a transportability of the transferring and fixing belt 13 is stabilized and since the fixing nip is formed in a direction in which the paper is not rolled on the transferring and fixing belt 13, there is an improvement in a paper separation. Furthermore, since the toner is not heated excessively as it moves with a peripheral surface of the transferring and fixing belt 13, the offset is prevented from occurring.

A structure of the transferring and fixing belt 13 is described below.

The transferring and fixing belt 13 includes a substrate provided with a heat generating layer, a surface of which is coated by a releasing layer. If the substrate is made of Ni or stainless steel, it is desirable that the thickness of the substrate is not greater than 40 μm. If the substrate is made of a heat resistant resin material, it is desirable that the thickness of the substrate is not greater than 100 μm. If the thickness of the substrate is greater that 100 μm, there is an increase in the stiffness of the belt, the flexibility that is a peculiarity of the belt is lost, and the running of the belt around the fixing roller and a nip formation are deteriorated. As a result of this, there is a deterioration of the paper separation and the toner fixity. The heat generating layer is made of a conductive material such as Ni, Ag, and stainless steel. An elastic layer that is made of silicone rubber may be provided as an intermediate layer on the heat generating layer to allow the toner image to be fixed uniformly.

The releasing layer that is provided on the surface of the belt is made of a fluorine contained resin and has to be at least 10-μm thick to ensure the abrasion resistance with the lapse of time.

Table 4 indicates a relationship between the heat capacity of the belt and the characteristics of the fixing unit upon changing the structure of the transferring and fixing belt 13. From results in table 4, to achieve the instantaneous start-up of the fixing unit and further energy conservation, it is desirable that the transferring and fixing belt 13 has a low heat capacity in a range of 0.019 J/K·cm$^2$ to 0.077 J/K·cm$^2$.

Evaluation of the table 4 is made under the following conditions.

Conditions for Experiment

Transferring and fixing medium (belt): structure according to (I) to (IX) in table 4

Fixing roller: ϕ38 (foamed silicone, layer thickness 5 mm)

Pressurizing roller: ϕ40 (1.5-mm thick iron core+0.5-mm thick silicone rubber+30-μm thick PFA)

Fixing condition: nip time (100 ms)

Toner: mentioned in the latter part of the present invention

TABLE 4

| No. | Structure of transferring and fixing belt | Heat capacity of belt J/K · cm$^2$ | Start-up time | Fixity Offset |
|---|---|---|---|---|
| (I) | PI (25 μm) + Ni (10 μm) + fluorine contained resin (10 μm) | 0.01 | Appropriate | Not appropriate |
| (II) | Ni (40 μm) + fluorine contained resin (20 μm) | 0.019 | Appropriate | Ok |
| (III) | Ni (40 μm) + silicone rubber (150 μm) | 0.038 | Appropriate | Appropriate |
| (IV) | Ni (40 μm) + silicone rubber (150 μm) + fluorine contained resin (30 μm) | 0.045 | Appropriate | Appropriate |
| (V) | PI (50 μm) + Ni (40 μm) + silicone rubber (150 μm) + fluorine contained resin (20 μm) | 0.052 | Appropriate | Appropriate |
| (VI) | PI (50 μm) + Ni (40 μm) + silicone rubber (200 μm) + fluorine contained resin (20 μm) | 0.068 | Appropriate | Appropriate |
| (VII) | PI (75 μm) + Ni (40 μm) + silicone rubber (200 μm) + fluorine contained resin (20 μm) | 0.072 | Appropriate | Appropriate |
| (VIII) | PI (100 μm) + Ni (40 μm) + silicone rubber (200 μm) + fluorine contained resin (20 μm) | 0.077 | Ok | Appropriate |
| (IX) | PI (100 μm) + Ni (40 μm) + silicone rubber (300 μm) + fluorine contained resin (30 μm) | 0.087 | Not appropriate | Appropriate |

By referring to table 4, it can be seen than if the heat capacity per unit area of the transferring and fixing belt is less than 0.019 J/K·cm$^2$, there is a substantial decrease in a temperature in the nip and the fixity is deteriorated. Therefore, this can be prevented by increasing the fixing temperature. However, with the increase in the fixing temperature, the energy conservation (high-speed start-up) cannot be achieved. Whereas, if the heat capacity per unit area of is greater than 0.077 J/K·cm$^2$, the heating time of the transferring and fixing belt becomes longer and similarly as in the previous case, the energy conservation (start-up time not greater than 30 seconds, desirably 10 seconds) cannot be achieved.

Figure 10A:
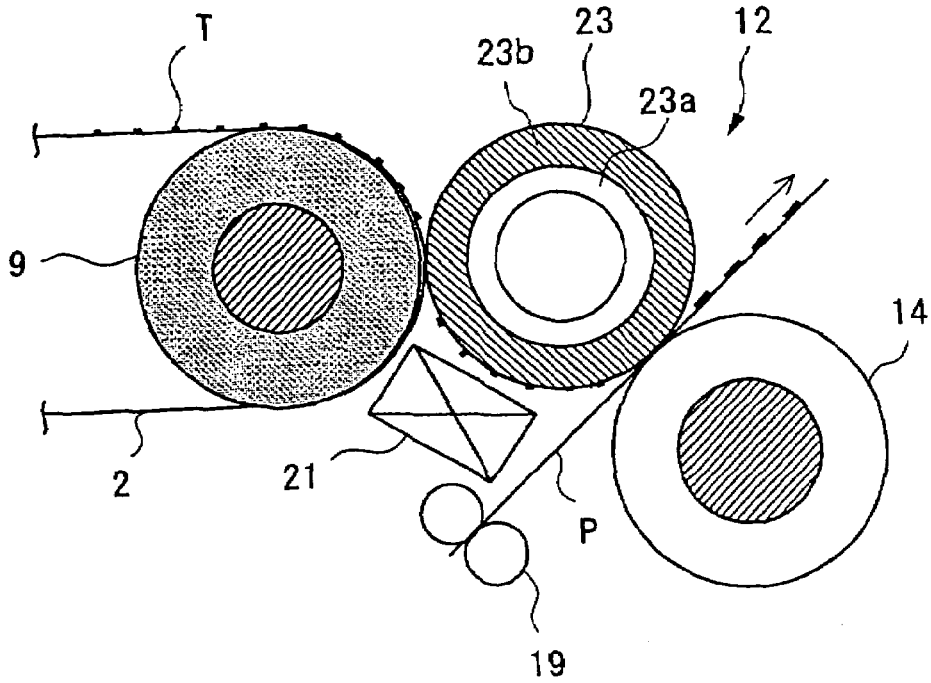
FIG. 10A is a diagram of a structure of still another fixing unit.
Figure 10B:
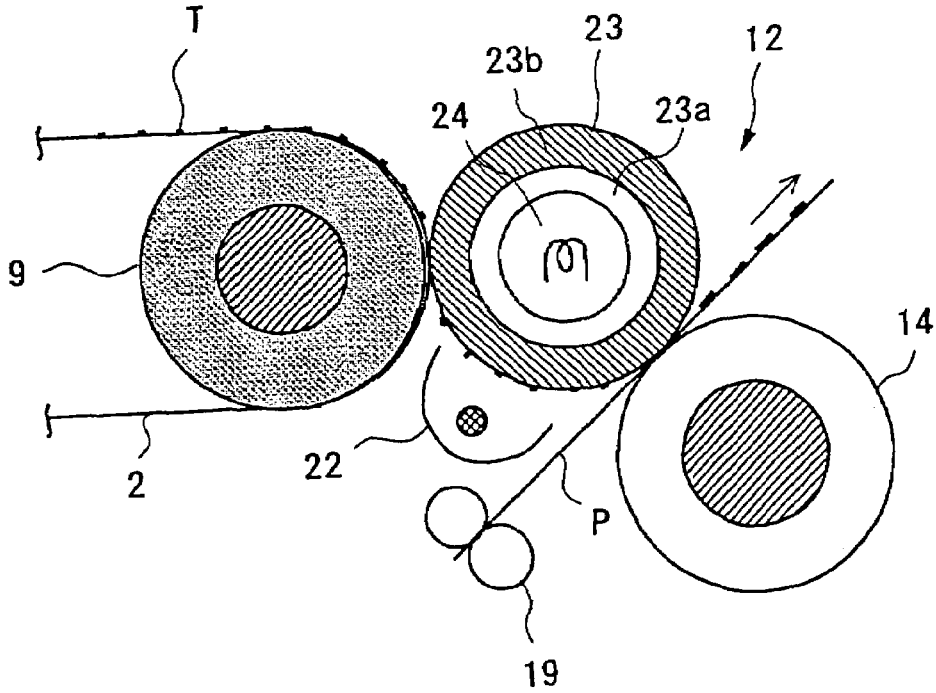
FIG. 10B is a diagram of a structure of still another fixing unit.

A structure in which the transferring and fixing belt 13 is used as the transferring and fixing member has been described so far. However, if the transferring and fixing member is a transferring and fixing roller 23 as shown in FIGS. 10A and 10B, the desired object, i.e. the prevention of hot offset, and the energy conservation can be achieved. The transferring and fixing roller 23 includes a core 23*a* made of a metal such as stainless steel, on which a heat generating layer 23*b* is provided. A surface of the heat generating layer 23*b* is coated by a releasing layer that is not shown in the diagram. The same materials used for the heat generating layer and the releasing layer in the transferring and fixing belt 15 can be used for the heat generating layer 23*b* and the releasing layer.

If the radiant heat source 22 is used, it is desirable to use a halogen lamp 24 inside the transferring and fixing roller 23 for the instantaneous start-up of the unit.

Toner that is used in the fixing unit according to the present invention is described below.

Many characteristics of toner that are related to the fixity of toner are known. Particularly, ½ outflow temperature (softening point) is known to be related to the fixity of toner. However, for the fixing unit according to the present invention, no relation between the ½ outflow temperature and (softening point) and the fixity has been observed and it was revealed that by using a toner that satisfies both the characteristics viz. the glass transition temperature in the range of 35° C. to 50° C. and the outflow-start temperature in the range of 80° C. to 110° C., a good fixity can be achieved.

If the glass transition temperature is less than 35° C., sometimes the hot offset occurs while fixing, whereas if the glass transition temperature is higher than 50° C., no sufficient fixity can be achieved and sometimes an image tend to come off from the paper.

If the outflow-start temperature is less than 80° C., sometimes the hot offset occurs while fixing, whereas if the outflow-start temperature is higher than 110° C., no sufficient fixity can be achieved and sometimes the image tend to come off from the paper.

The glass transition temperature, the outflow-start temperature, and the peak molecular weight are measured by the following methods.

TG-DSC system TAS-100 manufactured by RIGAKU CORPORATION was used as an apparatus to measure the glass transition temperature Tg. To start with, about 10 mg of a sample is put in the sample container made of aluminum and the sample container is mounted on the holder unit. The holder unit is set in the electric furnace. The sample is heated by raising the temperature from the room temperature to 150° C. at a programming rate of 10° C./min and left to be at 150° C. for 10 minutes. Then the sample is cooled down to the room temperature and left to be at the room temperature for 10 minutes. The sample is heated again in the nitrogen atmosphere up to 150° C. at the programming rate of 10° C./min and the DSC measurement was carried out. The glass transition temperature Tg was calculated from the point of contact of the tangent of the endothermic curve near the glass transition point Tg and a base line, by using the analysis system in TAS-100 system.

Outflow-start Temperature

Figure 11A:
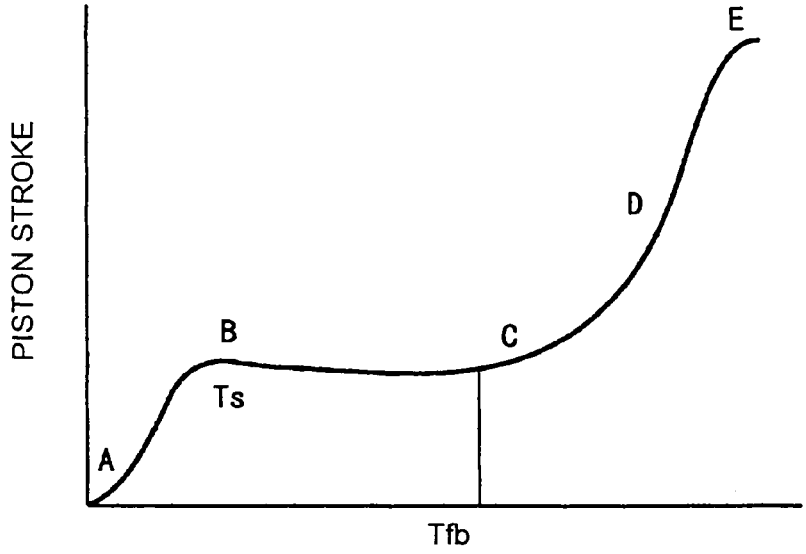
FIG. 11A is a graph of a flow curve of a flow tester.
Figure 11B:
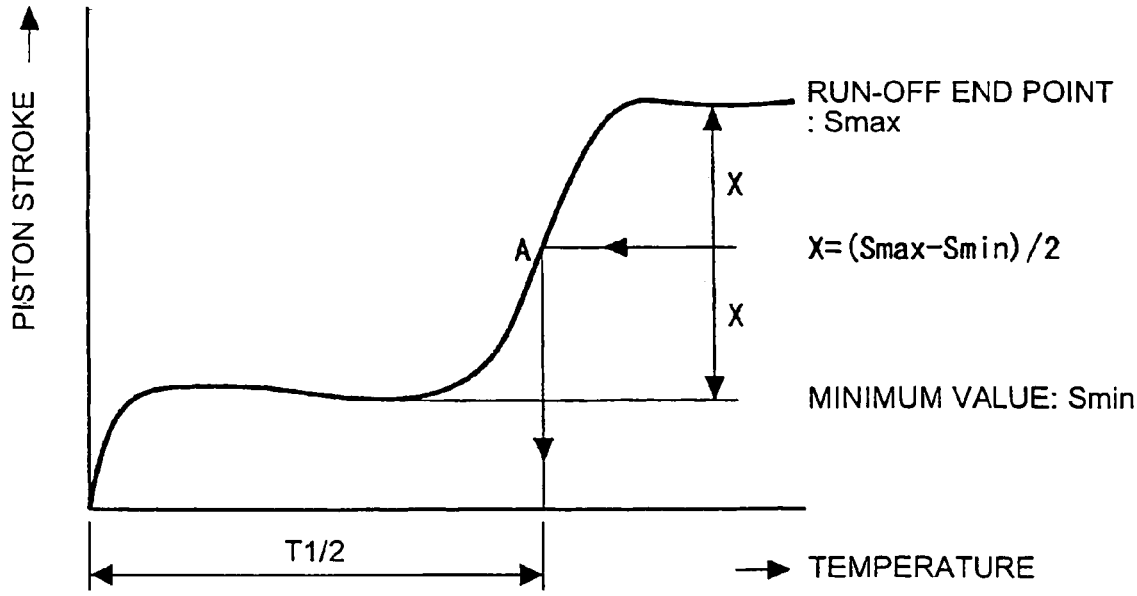
FIG. 11B is a graph of the flow curve of the flow tester.

The outflow-start temperature of toner can be measured by using the flow tester. An elevated flow tester CFT500D manufactured by SHIMADZU SEISAKUSHO can be used as a flow tester. The flow curve of the flow tester is data shown in FIG. 11A and 11B and each temperature can be read from the flow curve of this flow tester. In FIG. 11A, Tfb is the outflow-start temperature and temperature T½ is a melting temperature in a method of 1;2.

Conditions for Measurement:

Load: 5 kg/cm$^2$

Programming rate: 3.0° C./min

Bore diameter of die: 1.00 mm

Length of die: 10.0 mm

Peak Molecular Weight

The peak molecular weight GPC (gel permeation chromatography) of a toner component is measured by the following method. About 1 g of a toner is weighed precisely in an Erlenmeyer flask and 10 g to 20 g of THF (tetrahydrofuran) is added to it to make a THF solution with 5% to 10% binder concentration. A column is allowed to stabilize in a heat chamber at 40° C. THF is poured as a solvent at a rate of flow 1 ml/min to the column and 20 μl of THF sample solution is poured. The molecular weight of the sample is calculated from a relationship between a retention time and logarithmic value of a calibration curve that is prepared by a monodispersed polystyrene standard sample. A monodispersed polystyrene standard sample with the molecular weight in a range of $2.7\times10^2$ to $6.2\times10^2$ manufactured by TOSOH CORPORATION is to be used. A refractive index (RI) detector is used as a detector. A combination of TSKgel, G1000H, G2000H, G2500H, G3000H, G4000H, G5000H, G6000H, G7000H, and GMH manufactured by TOSOH CORPORATION is used as a column.

Resins having the following composition that satisfy the required toner characteristics can be used as a binder resin in the toner according to the present invention.

The examples of the binder resin are monopolymers of styrenes such as polyester, polystyrene, poly p-chlorostyrene, polyvinyl toluene and their substitutes, and copolymers of styrene such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinylmethyl ether copolymers, styrene-vinylethyl ether copolymers, styrene-vinylmethyl ketone copolymers, styrene-butadiene copolymers, styrene-isoprene copolymers, styrene-acrylonitrile indene copolymers, styrene-maleic acid copolymers, and styrene-maleate copolymers.

Moreover, the following resins upon mixing can be used as a binder resin. The examples are polymethyl methacrylate, polybutyl methacrylate, polyvinyl chloride, polyvinyl acetate, polyethylene, polypropylene, polyurethane, polyamide, epoxy resin, polyvinyl butyral, polyacrylic acid resins, rosin, modified rosin, turpentine resins, phenol resins, aliphatic hydrocarbon resins or alicyclic hydrocarbon resins, aromatic petroleum resins, chlorinated paraffin, and paraffin wax.

Among these resins, polyester resins are desirable as sufficient fixity can be achieved. The polyester resins are obtained by a condensation polymerization of an alcohol and a carboxylic acid. Examples of alcohols that can be used are diols such as polyethylene glycol, diethylene glycol, triethylene glycol, 1,2-propylene glycol, 1,3-propylene glycol, 1,4-butandiol, neopentyl glycol, and 1,4-butanediol, ethered bisphenols such as 1,4-bis(hydroxymethyl)cyclohexane, bisphenol A, hydrogen additive bisphenol A, polyoxyethylened bisphenol A, and polyoxypropylened bisphenol A, dihydric alcohol monomers in which the abovementioned resins are replaced by a saturated or an unsaturated hydrocarbon group having a carbon number from 3 to 22, and other dihydric alcohol monomers.

Examples of carboxylic acids that can be used to obtain the polyester resin are maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, a dihydric organic acid monomer in which the abovementioned acids are replaced by a saturated or an unsaturated hydrocarbon group having carbon number from 3 to 22, acid anhydrides of these acids, dimers of lower alkyl esters and linoleic acid, and other dihydric organic acid monomers.

For obtaining the polyester resin that is to be used as the binder resin, it is appropriate to use not only a polymer of a bifunctional monomer mentioned above, but also a polymer that contains a component formed by a polyfunctional monomer not less than a trifunctional monomer. Examples of a polyhydric alcohol monomer not below the trihydric alcohol monomers that are polyfunctional monomers are, sorbitol, 1,2,3,6-hexanetetrol, 1,4-sorbitan, pentaerythritol, dipentaerythritol, tripentaerythritol, cane sugar, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of polyhydric carboxylic acid monomers not below the trihydric carboxylic acid monomers are 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxy)methane, 1,2,7,8-octanetetracarboxylic acid, enboltrimeric acid, and acid anhydrides of these compounds.

All known colorants for toner can be used. As a colorant for black color, colorants such as carbon black, aniline black, furnace black, and lamp black can be used. As a colorant for cyan, colorants such as phthalocyanine blue, methylene blue, victoria blue, methyl violet, aniline blue, and ultra marine blue can be used. As a colorant for magenta, colorants such as rhodamine 6G lake, dimethyl quinacridone, watching red, rose red iron oxide, rhodamine B, and alizarin lake can be used. As colorant for yellow, colorants such as chrome yellow, benzidine yellow, hanza yellow, naphthol yellow, molybdenum orange, quinoline yellow, and tartrazine can be used.

A mold releasing agent can be included in the toner according to the present invention to improve toner release ability on a surface of the transferring and fixing member while fixing. Any known mold releasing agent can be used, and particularly, free fatty acid-free carnauba wax, montan wax, oxidized rice wax, and ester wax can be used independently or in combination. A carnauba wax that has micro crystals, acid number not greater than 5, and a particle size not bigger than 1 μm when dispersed in a toner binder is desirable. Regarding the montan wax, a refined montan wax rather than a normal mineral wax and similar to the carnauba wax, having micro crystals and acid value from 5 to 14, is desirable. The oxidized rice wax is an air oxidized rice bran wax and it is desirable that it has an acid value from 10 to 30. If the acid value of each wax is below the range, a low temperature fixing temperature rises and the fixing at a low temperature becomes insufficient. Whereas, if the acid value is above the range, a cold offset temperature rises and the fixing at a low temperature becomes insufficient. An amount of the wax to be added is from 1 part by weight by weight to 15 parts by weight of 100 for 100 parts by weight of the binder resin and the desirable amount is in a range of 3 parts by weight to 10 parts by weight. If the amount is less than 1 part by weight, the toner release effect is poor and the desired effect cannot be achieved. If the amount is more than 15 parts by weight, a spent to a carrier is remarkable.

A charge controlling agent can be included in a toner to impart a charge to the toner. All known conventional charge controlling agents can be used. The examples of a positive charge controlling agent are nigrosin, basic dyes, lake pigments of the basic dyes, and quaternary ammonium salt compounds, and examples of a negative charge controlling agent are metal salts of monoazo pigments, salicylic acid, naphthoic acid, and metal complexes of dicarboxylic acid. An amount to be used of this charge controlling agent is determined by a type of the binder resin, presence or absence of an additive that is used according to the requirement, and a method of toner manufacturing including a dispersion method, and is not restricted to any particular amount. The amount in a range of 0.01 parts by weight to 8 parts by weight of the charge controlling agent for 100 parts by weight of the binder resin is used and the desirable amount is in a range of 0.1 parts by weight to 2 parts by weight. If the amount is less than 0.01 parts by weight, an effect with respect to with respect to a change in an amount of charging Q/M during a change in an environment, is small and if the amount is more than 8 parts by weight, the low temperature fixity is deteriorated.

Chromium contained monoazo pigments, cobalt contained monoazo pigments, and iron contained monoazo pigments can be used independently or in combination as the metal contained monoazo pigments. By adding these monoazo pigments, time until saturation) of an amount of charge Q/M in a developer is even superior. The amount of the metal contained monoazo pigment to be used is determined similarly as the amount of the charge controlling agent, by the type of the binder resin, the presence or absence of the additive that is used according to the requirement, and the method of toner manufacturing including the dispersion method, and is not restricted to any particular method. The amount is in a range of 0.1 parts by weight to 10 parts by weight of the monoazo pigments for 100 parts by weight of the binder resin used and the desirable amount is in a range of 1 part by weight to 7 parts by weight. If the amount is less than 0.1 parts by weight, the effect is poor and if the amount is more than 10 parts by weight, defects such as a decline in a saturation level of the charging amount occur.

It is particularly desirable to use a metal salt of a derivative of salicylic acid in a color toner. However, charging of the toner can be stabilized by adding a transparent or a white color substance according to the requirement that does not cause a color toner of the color toner to be lost. Concretely, organic boron salts, fluorine contained quaternary ammonium salts, and calyx allene compounds are used. However, it is not restricted to these compounds.

To improve fluidity, hydrophobic silica, titanium oxide, alumina may be used as an external additive. Metal salts of fatty acids and polyvinylidene fluoride may also be used as an external additive according to the requirement.

A magnetic material can be included in the toner according to the present invention and the toner can be used as a magnetic carrier. Iron oxides such as magnetite, hematite, and ferrite, metals such as iron, cobalt, and nickel or alloys of these metals with metals such as aluminum, cobalt, copper, lead, magnesium, tin, zinc, antimony, beryllium, bismuth, cadmium, calcium, manganese, selenium, titanium, tungsten, and vanadium and their mixtures are examples of the magnetic material that are to be included in the magnetic toner.

It is desirable to use these ferromagnetic materials having an average particle size in a range of 0.1 μm to 2 μm and an amount to be included in the toner is approximately in a range of 20 parts by weight to 200 parts by weight for 100 parts by weight of the resin component. The desirable amount is 40 parts by weight to 150 parts by weight for 100 parts by weight of the resin component.

For using the toner according to the present invention as a two-component developer, all known carriers can be used as a magnetic carrier. Examples of the carrier are magnetic powders such as iron powder, ferrite powder, and nickel powder, and materials such as glass bids, a surface of which is treated by resin. Normally, an average particle size of these powder particles is in a range of 10 μm to 1000 μm, and the desirable particle size is in a range of 30 μm to 500 μm.

The examples of resin powders that can be used for coating the particles of the magnetic carrier are, styrene-acrylic copolymers, silicone resins, maleic acid resins, fluorine contained resins, polyester resins, and epoxy resins. In a case of the styrene-acrylic resin, it is desirable to use a copolymer resin that has styrene content in a range of 30 percent by weight to 90 percent by weight. In this case, if the styrene content is less than 30 percent by weight, developing characteristics are poor and if the styrene content is more than 90 percent by weight, a coating film becomes hard and tends to come of easily, thereby shortening a life of the magnetic carrier.

Any silicone resin that has been known so far may be used. Silicone resins available in a market such as KR261, KR271, KR272, KR275, KR280, KR282, KR285, KR251, KR155, KR220, KR201, KR204, KR205, KR206, SA-4, ES1001, ES1001N, ES1002T, and KR 3093 manufactured by SHIN-ETSU SILICONES, and SR2100, SR2101, SR2107, SR2110, SR2108, SR2109, SR2115, SR2400, SR2410, SR2411, SH805, SH806A, and SH840 manufactured by TORAY SILICONE CO., LTD., can be used. An amount in a range of 1 percent by weight to 10 percent by weight of the silicone resin with respect to a normal magnetic carrier particle can be used. As a method of forming a coating layer of the resin, the layer may be applied on a surface of the particles of the magnetic carrier by a method such as spraying and soaking.

Moreover, apart from the resins mentioned above, an adhesive agent, a hardening agent, a lubricant, a conductive agent, and a charge controlling agent may be included in the resin coating layer of the carrier.

EXAMPLES

Example 1 of Toner-making

Polyester resin (polyester obtained by coagulating fumaric acid, terephthalic acid, polyethylene glycol, EO (ethoxylated) bisphenol A, and PO adduct): 100 parts by weight Carbon black (#44 manufactured by MITSUBISHI CARBON CORPORATION): 8 parts by weight Carnauba wax: 5 parts by weight A compound of a metal salt of salicylic acid: 3 parts by weight After mixing admixture having such a composition by stirring sufficiently in a Henschel mixer, it was heated and fused for approximately 30 minutes at a temperature in a range of 130° C. to 140° C. in a roll mill, and then cooled down to a room temperature. A kneaded mixture that was obtained was pulverized and classified in a jet mill, and a toner with a weight average particle size 6.0 μm was obtained (toner 1)

The glass transition temperature of this toner was 48.5° C. and the outflow-start temperature of the toner was 102.3° C. The peak molecular weight of the toner was 6500. For 3 parts by weight of this toner, 100 parts by weight of a silicone resin solution (KR251 manufacture by SHIN-ETSU silicones) and 100 parts by weight of toluene were dispersed in a homomixer to prepare a solution that forms a coating layer. This solution that forms the coating layer was mixed with 97 parts by weight of a magnetic carrier that has a coating layer formed on a surface of 1000 parts by weight of spherical ferrite with an average particle size 50 μm, in a ball mill and a developer was obtained (developer 1).

Example 2 of Toner-making

Polyester resin (polyester obtained by coagulating trimellitic acid, terephthalic acid, polyethylene glycol, EO bisphenol A, PO adduct): 100 parts by weight Carbon black (#44 manufactured by MITSUBISHI CARBON CORPORATION): 8 parts by weight Ester wax: 5 parts by weight Compound of metal salt of salicylic acid: 3 parts by weight.

After mixing a mixture having such a composition by stirring sufficiently in the Henschel mixer, it was heated and fused for approximately 30 minutes at a temperature in a range of 130° C. to 140° C. in the roll mill, and then cooled down to the room temperature. A kneaded mixture that was obtained was pulverized and classified in the jet mill, and a toner with a weight average particle size 5.5 μm was obtained (toner 1).

The glass transition temperature of this toner was 45.5° C. and the outflow-start temperature of the toner was 105.3° C. The peak molecular weight of the toner was 7500. For 3 parts by weight of this toner, 100 parts by weight of the silicone resin solution (KR251 manufactured by SHIN-ETSU SILICONES) and 100 parts by weight of toluene were dispersed in the homomixer to prepare a solution that forms the coating layer. This solution that forms the coating layer was mixed with 97 parts by weight of the magnetic carrier that has the coating layer formed on surface of 1000 parts by weight of the spherical ferrite with an average particle size 50 μm, in a ball mill and a developer was obtained (developer 2).

Example 3 of Toner-making

Polyester resin (polyester obtained by coagulating trimellitic acid, terephthalic acid, polyethylene glycol, EO bisphenol A, PO adduct): 100 parts by weight Carbon black (#44 manufactured by MITSUBISHI CARBON CORPORATION): 8 parts by weight Carnauba wax: 5 parts by weight Compound of a metal salt of salicylic acid: 3 parts by weight After mixing a mixture having such a composition by stirring sufficiently in the Henschel mixer, it was heated and fused for approximately 30 minutes at a temperature in the range of 130° C. to 140° C. in the roll mill, and then cooled down to the room temperature. A kneaded mixture that was obtained was pulverized and classified in a jet mill and a toner with a weight average particle size 6.5 μm was obtained (toner 3).

The glass transition temperature of this toner was 41.5° C. and the outflow-start temperature of the toner was 94.6° C. The peak molecular weight of the toner was 4000. For 3 parts by weight of this toner, 100 parts by weight of the silicone resin solution (KR251 manufactured by SHIN-ETSU SILICONES) and 100 parts by weight of toluene were dispersed in the homomixer to prepare a solution that forms the coating layer. This solution that forms the coating layer was mixed with 97 parts by weight of the magnetic carrier that has a coating layer formed on surface of 1000 parts by weight of the spherical ferrite with an average particle size 50 μm, in the ball mill and a developer was obtained (developer 3).

Example 1 of Toner-making for Comparison

Polyester resin (polyester obtained by coagulating fumaric acid, terephthalic acid, polyethylene glycol, and EO adduct of bisphenol A): 100 parts by weight Carbon black (#44 manufactured by MITSUBISHI CARBON CORPORATION): 8 parts by weight Carnauba wax: 5 parts by weight Compound of a metal salt of salicylic acid: 3 parts by weight After mixing a mixture having such a composition by stirring sufficiently in the Henschel mixer, it was heated and fused for approximately 30 minutes at a temperature in the range of 130° C. to 140° C. in the roll mill, and then cooled down to the room temperature. The kneaded mixture that was obtained was pulverized and classified in the jet mill, and a toner with a weight average particle size 6.0 μm was obtained (toner 1 for comparison)

The glass transition temperature of this toner was 43.5° C. and the outflow-start temperature of the toner was 78.2° C. The peak molecular weight of the toner was 4200. For 3 parts by weight of this toner, 100 parts by weight of the silicone resin solution (KR251 manufactured by SHIN-ETSU SILICONES) and 100 parts by weight of toluene were dispersed in the homomixer to prepare a solution that forms the coating layer. This solution that forms the coating layer was mixed with 97 parts by weight of the magnetic carrier that has the coating layer formed on the surface of 1000 parts by weight of spherical ferrite with an average particle size 50 μm, in the ball mill and a developer was obtained (developer 1 for comparison)

Example 2 of Toner-making for Comparison

Polyester resin (polyester obtained by coagulating trimellitic acid, terephthalic acid, polyethylene glycol, and PO adduct of bisphenol A): 100 parts by weight Carbon black: (#44 manufactured by MITSUBISHI CARBON CORPORATION): 8 parts by weight, carnauba wax: 5 parts by weight Compound of a metal salt of salicylic acid: 3 parts by weight After mixing a mixture having such a composition by stirring sufficiently in the Henschel mixer, it was heated and fused for approximately 30 minutes at a temperature in the range of 130° C. to 140° C. in the roll mill, and then cooled down to the room temperature. The kneaded mixture that was obtained was pulverized and classified in the jet mill, and a toner with a weight average particle size 6.0 μm was obtained (toner 2 for comparison).

The glass transition temperature of this toner was 48.5° C. and the outflow-start temperature of the toner was 112.2° C. The peak molecular weight of the toner was 8500. For 3 parts by weight of this toner, 100 parts by weight of the silicone resin solution (KR251 manufactured by SHIN-ETSU SILICONES) and 100 parts by weight of toluene were dispersed in the homomixer to prepare a solution that forms the coating layer. This solution that forms the coating layer was mixed with 97 parts by weight of the magnetic carrier that has the coating layer formed on the surface of 1000 parts by weight of spherical ferrite with an average particle size 50 μm, in the ball mill and a developer was obtained (developer 2 for comparison).

Example 3 of Toner-making for Comparison

Polyester resin (polyester obtained by coagulating fumaric acid, polyethylene glycol, and EO adduct of bisphenol A): 100 parts by weight Carbon black (#44 manufactured by MITSUBISHI CARBON CORPORATION): 8 parts by weight Carnauba wax: 5 parts by weight Compound of a metal salt of salicylic acid: 3 parts by weight After mixing a mixture having such a composition by stirring sufficiently in the Henschel mixer, it was heated and fused for approximately 30 minutes at a temperature in the range of 130° C. to 140° C., and then cooled down to the room temperature. The kneaded mixture that was obtained was pulverized and classified in the jet mill, and a toner with a weight average particle size 6.0 μm was obtained (toner for comparison 3).

The glass transition temperature of this toner was 33.5° C. and the outflow-start temperature of the toner was 98.2° C. The peak molecular weight of the toner was 5200. For 3 parts by weight of this toner, 100 parts by weight of the silicone resin solution (KR251 manufactured by SHIN-ETSU SILICONES) and 100 parts by weight of toluene were dispersed in the homomixer to prepare a solution that forms the coating layer. This solution that forms the coating layer was mixed with 97 parts by weight of the magnetic carrier that has the coating layer formed on the surface of 1000 parts by weight of spherical ferrite with an average particle size 50 μm, in the ball mill and a developer was obtained (developer 3 for comparison).

Example 4 of Toner Making for Comparison

Polyester resin (polyester obtained by coagulating trimellitic acid, terephthalic acid, polyethylene glycol, and EO adduct of bisphenol A): 100 parts by weight Carbon black (#44 manufactured by MITSUBISHI CARBON CORPORATION): 8 parts by weight Carnauba wax: 5 parts by weight Compound of a metal salt of salicylic acid: 3 parts by weight After mixing a mixture having such a composition by stirring sufficiently in the Henschel mixer, it was heated and fused for approximately 30 minutes at a temperature in the range of 130° C. to 140° C., and then cooled down to the room temperature. The kneaded mixture that was obtained was pulverized and classified in the jet mill, and a toner with a weigh average particle size 6.0 μm was obtained (toner 4 for comparison).

The glass transition temperature of this toner was 53.5° C. and the outflow-start temperature of the toner was 103.6° C. The peak molecular weight of the toner was 6600. For 3 parts by weight of this toner, 100 parts by weight of the silicone resin solution (KR251 manufactured by SHIN-ETSU SILICONES) and 100 parts by weight of toluene were dispersed in the homomixer to prepare a solution that forms the coating layer. This solution that forms the coating layer was mixed with 97 parts by weight of the carrier that has the coating layer formed on the surface of 1000 parts by weight of spherical ferrite with an average particle size 50 μm, in the ball mill and a developer was obtained (developer 4 for comparison).

Fixity of the toners was evaluated by using the developers obtained so far.

By using an image forming apparatus that has the fixing unit shown in FIG. 9 installed as an experiment equipment, a copy test was performed by setting a paper of type 6200 manufactured by RICOH COMPANY LIMITED. A temperature of the transferring and fixing belt at which a survival rate of image density upon rubbing a fixed image by using a pad is not less than 70% is let to be the lower limit temperature for fixing. Moreover, if the fixing temperature is raised up, due to excessive fusion of the toner, all the toner is remained on the transferring and fixing belt without being fixed on a transfer material such as a paper. This remained toner adheres to a non-image area, thereby giving rise to the so called offset phenomenon. A range from a lower limit temperature for fixing to an upper limit temperature for fixing is let to be a range of fixing temperature.

Result of evaluation is shown in table 5. In a column for "evaluation result" in table 5, a lower limit temperature for fixing not greater than 140° C., an upper limit temperature for fixing not less than 220° C., and a range of fixing temperature not less not below 60° C. is let to be appropriate and any temperature other than these is let to be not appropriate.

TABLE 5

| Toner No. | Lower limit temperature for fixing (° C.) | Upper limit temperature for fixing (range of fixing temperature is mentioned in bracket (° C.) | Evaluation result |
|---|---|---|---|
| Toner 1 | 130 | 200 (70) | Appropriate |
| Toner 2 | 135 | 210 (75) | Appropriate |
| Toner 3 | 125 | 190 (65) | Appropriate |
| Toner 1 for comparison | 125 | 140 (15) | Not appropriate |
| Toner 2 for comparison | 165 | 245 (80) | Not appropriate |
| Toner 3 for comparison | 130 | 150 (20) | Not appropriate |
| Toner 4 for comparison | 160 | 225 (65) | Not appropriate |

From the result is table 5, when the toners 1 to 3 according to the present invention were used, the lower limit temperature for fixing could be reduced and a range of fixing temperature not below a certain temperature could be achieved. This enables to reduce the start-up time of the unit by a great extent and to save even more energy. In addition to this, defective fixing and hot offset do not occur and a good fixity of the image can be achieved.

According to a fixing unit and an image forming apparatus of the present invention, by heating a fixing belt that has a low heat capacity by an induction-heating unit it is possible to shorten a start-up time and to save energy. Moreover, by using a low temperature fixing toner both of the fixity and the prevention of offset can be achieved.

According to a second aspect of the present invention, since the heat capacity of the fixing belt is in a range of 0.017 J/K·cm$^2$ to 0.077 J/K·cm$^2$, with a suitable combination of the toner, it is possible to save energy and shorten the start-up time. Moreover, the fixity and the prevention of offset can be achieved.

According to a third aspect of the present invention, since a peak molecular weight of the toner is in a range of 3000 to 8000, this contributes to shortening of the start-up time as well as has a good effect on heat resistance and durability of the belt. Further, it has excellent paper adaptability and a defective fixing and offset cannot occur easily.

According to a fourth aspect of the present invention, out of a fixing member and a pressurizing member, since at least the fixing member has a thermal insulation structure, conduction of heat from the fixing belt is less and heat loss is reduced, thereby enable to improve the heating efficiency.

According to a fifth aspect of the present invention, the fixing member is disposed inside a loop of the fixing belt and hardness of the pressurizing member is let to be more than that of the fixing member. Therefore, the nip can be formed in a direction such that the paper cannot get wrapped around the fixing belt and there is an improvement in a paper separating ability.

According to a sixth aspect of the present invention, the pressurizing member is a pressurizing roller and the fixing belt is rotated by a drive transmitted from the pressurizing roller. Therefore, transportation by the fixing belt is stable.

According to the present invention, a lower limit temperature for fixing can be reduced and a range of fixing temperature not less than a certain temperature can be maintained. Therefore, it is possible to provide a fixing unit that starts up instantaneously and saves even more energy, as well as avoids an occurrence of defective fixing and hot offset, and achieves good fixity.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing unit comprising:

an endless fixing belt having a heat generating layer of a thickness not more than 40 μm and a releasing layer of a thickness not less than 10 μm;

a heating unit that heats the fixing belt with electromagnetic induction;

a fixing member and a pressurizing member that are in a pressed contact, wherein the fixing belt passes through a nip between the fixing member and the pressurizing member, and a recording material that holds an unfixed toner image is passed through the nip to fix the toner image, wherein a toner to form the toner image includes at least a binder resin, a colorant, and a mold releasing agent, and has a glass transition temperature in a range of 35° C. to 50° C. and an outflow-start temperature in a range of 80° C. to 110° C., and wherein a heat capacity of the fixing belt is in a range of 0.017 J/K·cm$^2$ to 0.077 J/K·cm$^2$.

2. The fixing unit according to claim 1, wherein a peak molecular weight of the toner is in a range of 3000 to 8000.

3. The fixing unit according to claim 1, wherein out of the fixing member and the pressurizing member, at least the fixing member has a thermal insulating structure.

4. The fixing unit according to claim 1, wherein the fixing member is inside a loop of the fixing belt and a hardness of the pressurizing member is greater than a hardness of the fixing member.

5. The fixing unit according to claim 4, wherein the pressurizing member is pressurizing roller and the fixing belt is rotated by a transmission of drive from the pressurizing roller.

6. An image forming apparatus comprising:

an endless fixing belt having a heat generating layer of a thickness not more than 40 μm and a releasing layer of a thickness not less than 10 μm;

a heating unit that heats the fixing belt with electromagnetic induction;

a fixing member and a pressurizing member that are in a pressed contact, wherein the fixing belt passes through a nip between the fixing member and the pressurizing member, and a recording material that holds an unfixed toner image is passed through the nip to fix the toner image to thereby form an image on the recording material, wherein a toner to form the toner image includes at least a binder resin, a colorant, and a mold releasing agent, and has a glass transition temperature in a range of 35° C. to 50° C. and an outflow-start temperature in a range of 80° C. to 110° C., and wherein a heat capacity of the fixing belt is in a range of 0.017 J/K·cm$^2$ to 0.077 J/K·cm$^2$.

7. A fixing unit comprising:

a transferring and fixing member that includes a rotating body in a form of a roller or a belt on which a toner image is transferred;

a heating unit that heats a toner on the transferring and fixing member; and a pressurizing roller that forms a nip with the transferring and fixing member, wherein a toner image is fixed on a paper that passes through the nip formed between the transferring and fixing member and the pressurizing roller, and a toner that forms the toner image includes at least a binder resin, a colorant, and a mold releasing agent, and has a glass transition temperature in a range of 35° C. to 50° C. and an outflow-start temperature in a range of 80° C. to 110° C., and wherein a heat capacity of the fixing belt is in a range of 0.017 J/K·cm$^2$ to 0.077 J/K·cm$^2$.

8. The fixing unit according to claim 7, wherein a peak molecular weight of the toner is in a range of 3000 to 8000.

9. The fixing unit according to claim 7, wherein the heating unit is an induction heating source.

10. The fixing unit according to claim 7, wherein the heating unit is a radiant heat source.

11. The fixing unit according to claim 7, wherein either any one or both of the transferring and fixing member and the pressurizing roller has a thermal insulating structure.

12. The fixing unit according to claim 11, wherein the pressurizing roller is stiff and has the thermal insulating structure, and a hardness of the pressurizing roller is greater than a hardness of the transferring and fixing member.

13. The fixing unit according to claim 12, wherein the transferring and fixing member is rotated by a transmission of drive from the pressurizing roller.

14. The fixing unit according to claim 7, wherein the transferring and fixing member is a transferring and fixing belt that has a low heat capacity.

15. The fixing unit according to claim 14, wherein a heat capacity per unit area of the transferring and fixing belt is in a range of 0.019 J/K·cm$^2$ to 0.077 J/K·cm$^2$.

16. An image forming apparatus for obtaining an image by transferring and fixing a toner image that is formed on an image carrier by a fixing unit, comprising:

a transferring and fixing member that includes a rotating body in a form of a roller or a belt on which a toner image is transferred;

a heating unit that heats a toner on the transferring and fixing member; and a pressurizing roller that forms a nip with the transferring and fixing member, wherein a toner image is fixed on a paper that passes through the nip formed between the transferring and fixing member and the pressurizing roller, and a toner that forms the toner image includes at least a binder resin, a colorant, and a mold releasing agent, and has a glass transition temperature in a range of 35° C. to 50° C. and an outflow-start temperature in a range of 80° C. to 110° C., and wherein a heat capacity of the fixing belt is in a range of 0.017 J/K·cm$^2$ to 0.077 J/K·cm$^2$.

17. An image forming apparatus, comprising a fixing device that fixes a toner image onto a recording material, wherein the fixing device includes a fixing belt;

a fixing roller and a pressurizing roller that are in a pressed contact, wherein the fixing belt passes through a nip between the fixing roller and the pressurizing roller, and the recording material that holds an unfixed toner image is passed through the nip to fix the toner image; and a heat roller that is heated by a heating unit, wherein the fixing belt is stretched over the heat roller and the fixing roller, the heating unit heats the heat roller with electromagnetic induction, the endless fixing belt having a heat capacity of a range of 0.017 J/K-cm$^2$ to 0.077 J/K-cm$^2$, and the toner to form the toner image includes at least a binder resin, a colorant, and a mold releasing agent, has a glass transition temperature in a range of 35° C. to 50° C., and has an outflow-start temperature in a range of 80° C. to 110° C.

18. The image forming apparatus according to claim 6, wherein the fixing belt has an elastic layer of a thickness of 150 μm to 200 μm.

19. The image forming apparatus according to claim 6, wherein the fixing member is a fixing roller, and all of an outer circumference of the fixing roller contacts the fixing belt.

* * * * *